US005826393A

United States Patent [19]

Wenzlaff et al.

[11] Patent Number: 5,826,393

[45] Date of Patent: Oct. 27, 1998

[54] FASTENERLESS MODULAR SHUTTER WITH ADJUSTABLE PANEL SUPPORT MEMBER

[75] Inventors: John C. Wenzlaff, Wonder Lake; Stephen J. Schreiner, Woodstock; Joseph P. Creasey, McHenry, all of Ill.; Alan MacGowan, Walworth, Wis.; Michael J. Ricard, Prospect Heights, Ill.; LeRoy Pohl, Elkhorn, Wis.; David E. May, Geneva, Ill.; David A. Bures, Bridgewater, N.J.

[73] Assignee: Selfix, Inc., Chicago, Ill.

[21] Appl. No.: 825,274

[22] Filed: Mar. 27, 1997

Related U.S. Application Data

[63] Continuation-in-part of Ser. No. 414,428, Mar. 31, 1995, abandoned, and a continuation-in-part of Ser. No. 585,490, Jan. 16, 1996, abandoned.

[51] Int. Cl.[6] ..... E06B 7/08

[52] U.S. Cl. ..... 52/473; 454/221

[58] Field of Search ..... 52/473; 454/221, 454/224, 278

[56] References Cited

U.S. PATENT DOCUMENTS

| | | | |
|---|---|---|---|
| 3,932,959 | 1/1976 | Jansons et al. | 52/473 X |
| 4,251,966 | 2/1981 | Foltman | 52/473 X |
| 4,765,110 | 8/1988 | MacLeod | 52/473 |
| 5,152,116 | 10/1992 | MacGowan | 52/473 |
| 5,265,391 | 11/1993 | Ricard et al. | 52/455 |
| 5,373,677 | 12/1994 | Vagedes | 52/473 |
| 5,524,407 | 6/1996 | Ricard et al. | 52/473 |

*Primary Examiner*—Christopher Kent
*Assistant Examiner*—Timothy B. Kang
*Attorney, Agent, or Firm*—Rockey, Milnamow & Katz

[57] ABSTRACT

An adjustable, fastenerless modular shutter includes end rails having an end wall and a pair of locking portions extending therefrom. The locking portions are slidably receivable in a pair of side rails and engage the side rails to resist separation of the end rails from the side rails during assembly of the shutter. An adjusting member located on the end rail permits adjustable engagement of a shutter panel to the end rail to permit positioning and retention of the shutter panel relative to one of the end rails.

66 Claims, 11 Drawing Sheets

FIG. 3
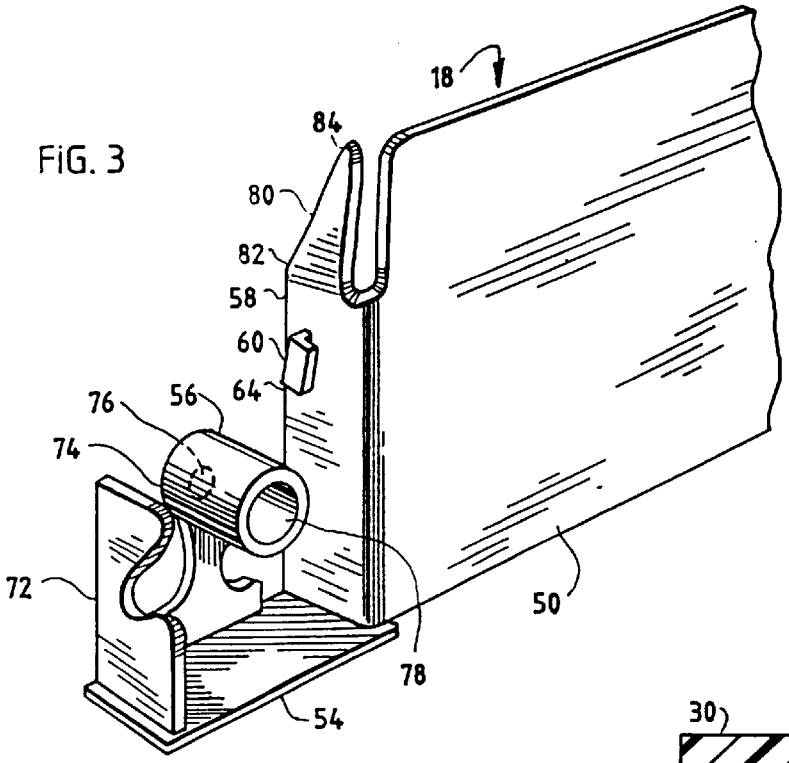
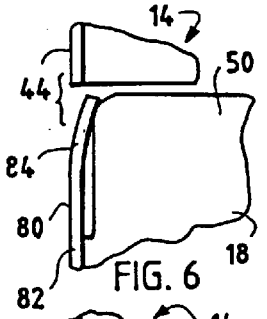
FIG. 6
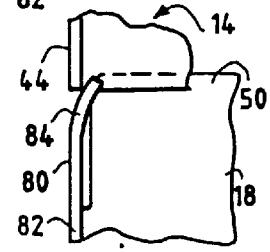
FIG. 7
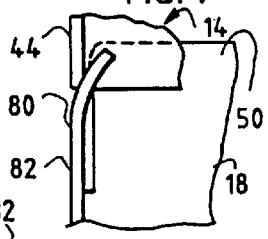
FIG. 8
FIG. 4
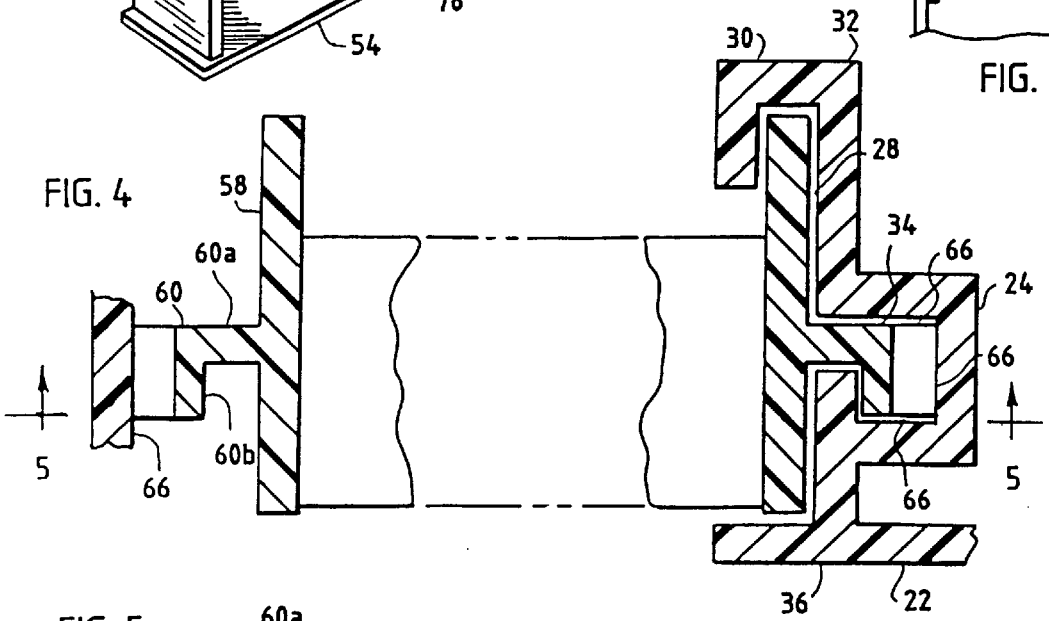
FIG. 5
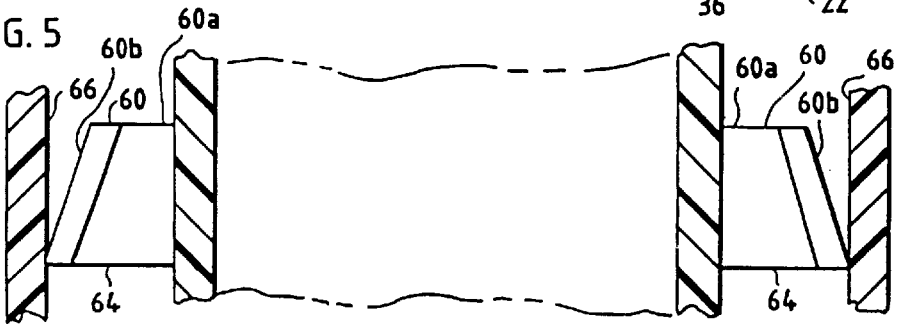

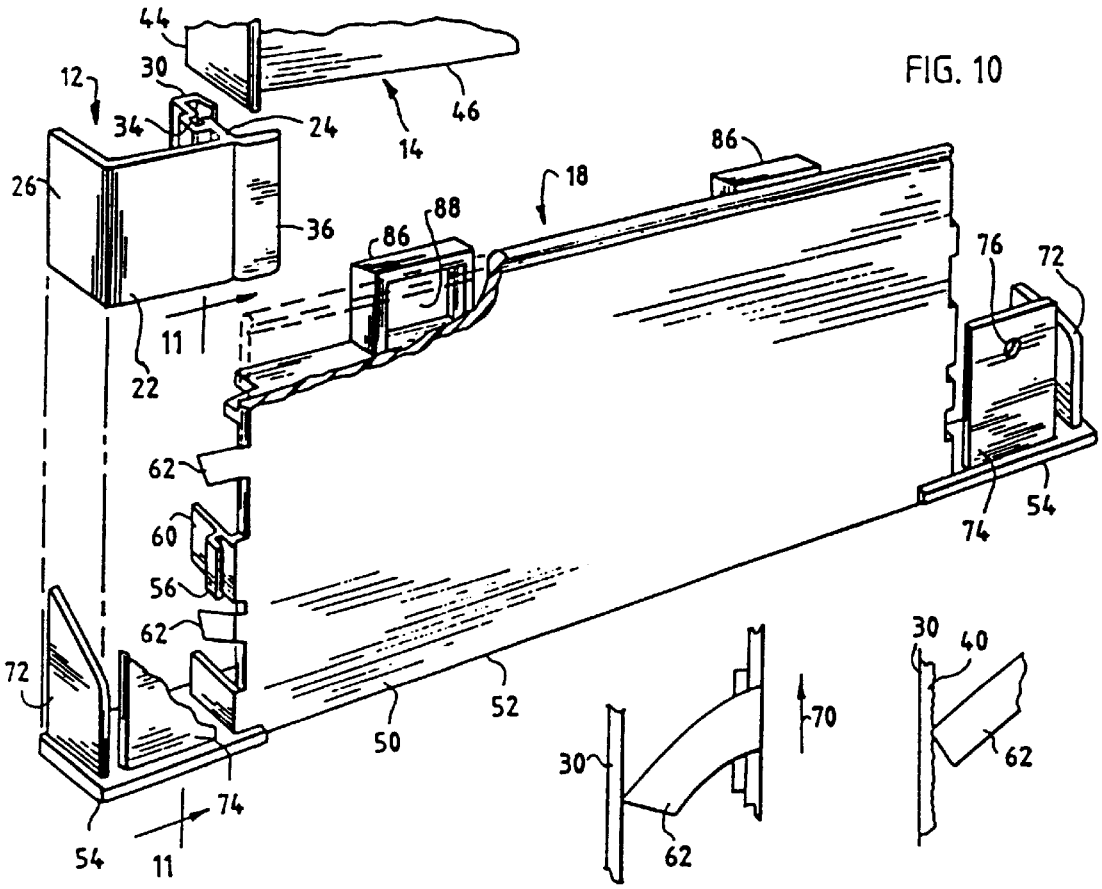
FIG. 10
FIG. 12
FIG. 12A
FIG. 11
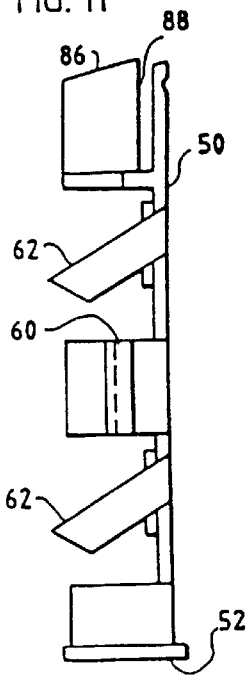
FIG. 13
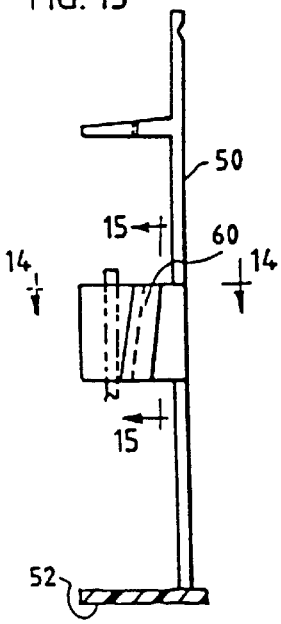
FIG. 14
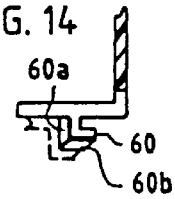
FIG. 15
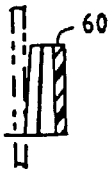

FASTENERLESS MODULAR SHUTTER WITH ADJUSTABLE PANEL SUPPORT MEMBER

RELATED APPLICATIONS

This application is a continuation-in-part of U.S. patent application Ser. No. 08/414,428, filed on Mar. 31, 1995, abandoned, and U.S. Patent application Ser. No. 08/585,490, filed on Jan. 16, 1996, abandoned.

FIELD OF THE INVENTION

This invention pertains to building shutters, and more particularly to fastenerless, adjustable modular shutters which include an adjustable panel support member and which remain in an assembled configuration, prior to mounting, without extra fasteners.

BACKGROUND OF THE INVENTION

Building shutters are available in a variety of decorative designs and configurations for installation adjacent to openings in buildings, such as windows. One known, popular type of shutter which is available is assembled from modular components which are available in a range of sizes. Such modular shutters are easily tailored for particular installations.

Examples of such modular shutters are disclosed in U.S. Pat. Nos. 4,251,966 to Foltman, entitled "Adjustable Height Shutter"; U.S. Pat. No. 5,152,166 to MacGowan, entitled "Modular Shutter Assembly"; and U.S. Pat. No. 5,265,391 to Ricard et al., entitled "Stabilized Modular Shutter", all of which patents are assigned to the assignee of this application. Other examples of modular shutters are disclosed in U.S. Pat. No. 5,765,110 to MacLeod, entitled "Adjustable Plastic Shutter" and U.S. Pat. No. 5,060,442 to Chubb, entitled "Louvered Plastic Building Product".

Conventional modular shutters have a pair of side rails, a central shutter panel which, for example, may be planar or louvered, and top and bottom end rails. Generally, the side rails are cut to meet the particular size requirements of the shutter installation. The shutter panels are cut or sized accordingly. The width of modular shutters can be adjusted by use of shutter panels, end rails and mullions of different dimensions. In addition, side rails of various widths, e.g., one inch or two inch widths, are available to tailor the shutter to the particular installation.

In many existing modular shutters, each shutter panel has a pair of runners extending along the opposite sides of the panel, transverse to the plane of the shutter panel. Typically, each of the side rails of such modular shutters has a channel formed on the inner wall thereof to slidably receive the runners of the shutter panel.

The end rails of many shutters also include runner portions which are slidably received in the side rails. Typically, such end rails also include depending tab-like portions which project into the side rails at the ends thereof, to retain the shape of the side rail and to properly position the end rail thereon.

In assembling such shutters, the end caps are assembled to the side rails. One end can be assembled before the central panel and side rails are assembled. Typically, the side rails and end rails are fastened together, such as by stapling, to prevent separation thereof. The side and end rails are fastened along the portion where the end rail runner and side rail inner wall are adjacent to each other. While temporarily fastening the shutter in the assembled configuration with fasteners facilitates installation, it is nevertheless a time consuming and laborious task.

When the shutter is installed, for example, adjacent to a window on a building surface, screws or other fasteners are driven through the side rails secure the shutter to the building surface.

One known type of shutter permits adjustment of the shutter panel relative to the side rails to minimize any gaps which may exist between the shutter panel and the end rails. Typically, such an adjustment is provided by a portion of the end rail or mullion which overlaps the shutter panel. In the known adjustable configuration, however, fasteners, such as staples, are required to maintain the shutter panels and mullion in position.

It would be desirable, therefore, to provide a shutter having the advantages of a modular design, while incorporating a fastenerless end rail to side rail configuration that would provide improved resistance to disengagement of the shutter components without the use of extra fasteners to secure the shutters in an assembled configuration prior to installation. It would also be desirable to provide such a fastenerless shutter in an arrangement that permits adjustment of the position of the shutter panel or panels, and optionally a mullion, relative to the end rails.

The flexure of the parts of the shutter may not necessarily be consistent over the life of the shutter in differing and often extreme environmental conditions. Furthermore, in the previously known designs, relatively small parts of the shutter were relied upon to support the panel member, by way of a predetermined flex of the part. Due to the weight of the panel member, such parts may not provide adequate support, thereby allowing the panels to slip. Louvered panels that slip within the shutter may reveal a gap at the top or bottom thereof.

It would be desirable, therefore, to provide a shutter having the advantages of a modular, adjustable, fastenerless design, while incorporating a configuration that would provide improved resistance to panel slippage, and which uses a positive engagement of the shutter panel to retain the panel in place in the assembled shutter. It would be further desirable for the shutter components to be sufficiently modular to permit the components to be used on shutters having various, differing width side rails.

SUMMARY OF THE INVENTION

A modular fastenerless shutter in accordance with the present invention incorporates side rails and end rails which are configured and interact to restrict and limit separation and disengagement of the end rails from the side rails prior to installation, without the use of extra fasteners, such as staples.

A modular fastenerless shutter incorporating one aspect of the present invention addresses this disengagement problem by providing an interfering engagement configuration which frictionally secures the end rails to the side rails during assembly. Such a configuration includes a locking portion, typically on the end rail, which interferingly, frictionally engages the other rail for resisting disengagement of the end rails from the side rail after assembly.

The fastenerless shutter in accordance with the present invention secures the end rails and side rails together, without extra fasteners, during assembly, and thus improves the resistance against disengagement (i.e., achieves a secure engagement) of the modular shutter assembly.

By securing the components together during assembly without requiring additional procedures, such as the use of fasteners, the assembly of shutters is simpler and faster, and the cost of assembly is reduced due to the reduction in assembly time and the elimination of fasteners.

In one embodiment of a fastenerless shutter incorporating the present invention, the end rails include a front wall and a pair of runner portions extending rearwardly from, and transverse to the front wall. Locking portions are located on each runner portion and have projections which engage the inner walls of the side rails.

An alternate embodiment of the fastenerless shutter includes a locking portion depending from the end cap which coacts with the inner and outer walls of an associated side rail.

End rails in accordance with an aspect of the present invention may also include an adjusting member which permits adjustment of the position of the central panel members and mullion relative to the end rails.

A fastenerless shutter incorporating the present invention includes a pair of side rails, a panel member disposed between and secured to the side rails, and end rails secured to the side rails. The end rails are disposed at either end of the panel member for enclosing the panel member.

Each of the side rails has a front wall, a generally planar inner wall, and an outer wall. The side rails are spaced apart one from the other with the inner walls facing each other and lying in generally parallel planes. The panel member has a central portion and a pair of runner portions disposed along the sides thereof. The runner portions are oriented generally parallel to the inner walls of the side rails. Each of the runner portions is engageable with an associated side rail to secure the panel member to each of the side rails.

The end rails have an end wall portion, and include a pair of locking portions slidably receivable in an associated side rail. Each locking portion includes at least one interferingly, frictionally engaging portion engageable with its associated side rail for resisting disengagement of the end rails from the side rails.

An adjustable, modular fastenerless shutter in accordance with the present invention incorporates side rails and end rails which are configured and interact to restrict and limit separation and disengagement of the end rails from the side rails prior to installation, without the use of extra fasteners, and which uses a positive engagement of an adjusting member with the panel member to selectively position and retain one or more panel members relative to the end rails of the shutter.

An adjustable, fastenerless shutter incorporating the present invention addresses the adjustability problem encountered with known shutters by providing a moveable adjusting member engageable with the end rails, which adjusting member is positioned against and abuts the panel member to provide positive retention of the panel member in place. The shutter further includes frictionally engaging projections on the end rails to prevent disengagement of the end rails from the side rails during and after assembly.

The adjustable shutter in accordance with the present invention includes an adjusting member which is slidably received in a support portion positioned on the shutter end rail. The adjusting member defines a channel which has serrations formed therein. The serrations coact with a locking element to permit unidirectional movement of the adjusting member toward the panel member and away from the end rail end wall.

In addition, because the components are secured together during assembly and before installation, without requiring additional procedures such as the use of fasteners, the assembly of the shutter and the fine adjustment of the shutter panel may be achieved simply and fast, and the cost of assembly may be reduced.

An adjustable, modular fastenerless shutter in accordance with another alternative embodiment of the present invention incorporates side rails and end rails which are configured and interact to restrict and limit separation and disengagement of the end rails from the side rails prior to installation, without the use of extra fasteners, and which uses a positive engagement of projections associated with the end rails that extend into openings formed in the side rails. An adjusting block member selectively engaged with an end rail is provided to adjustably engage a panel member to retain the panel member relative to one of the end rails. The block member may include an attachment strap to secure it to the end rail.

Numerous other features and advantages of the present invention will become readily apparent from the following detailed description of the invention, the accompanying drawings, and the appended claims, in which the details of the invention are fully and completely disclosed as part of the invention.

BRIEF DESCRIPTION OF THE FIGURES

FIG. 3 is an enlarged, fragmentary, perspective view of a representative top or bottom rail of the fastenerless modular shutter;

FIG. 4 is a cross-sectional view taken along line 4—4 of FIG. 1, with one side rail partially removed for clarity of illustration;

FIG. 5 is a cross-sectional view taken along line 5—5 of FIG. 4;

FIG. 6 partial elevational view of a depth adjustment tab of a representative top or bottom rail and an associated shutter panel, prior to engagement therebetween;

FIG. 7 is a view similar to FIG. 6 showing the depth adjustment tab as it engages the associated shutter panel;

FIG. 8 is a view similar to FIG. 7 showing the depth adjustment tab more fully engaging the associated shutter panel;

FIG. 10 is a partial exploded view of the fastenerless modular shutter which illustrates still another embodiment of a representative top or bottom rail which embodies the principles of the present invention;

FIG. 11 is a cross-sectional view taken along line 11—11 of FIG. 10;

FIG. 12 is a view illustrating an interference member of the representative top or bottom rail;

FIG. 12A illustrates an alternate embodiment of the interference member of FIG. 12;

FIG. 13 illustrates still another embodiment of the interference member;

FIG. 14 is a cross-sectional view taken along line 14—14 of FIG. 13;

FIG. 15 is a view taken along line 15—15 of FIG. 13;

DETAILED DESCRIPTION OF THE PREFERRED EMBODIMENTS

Figure 1:
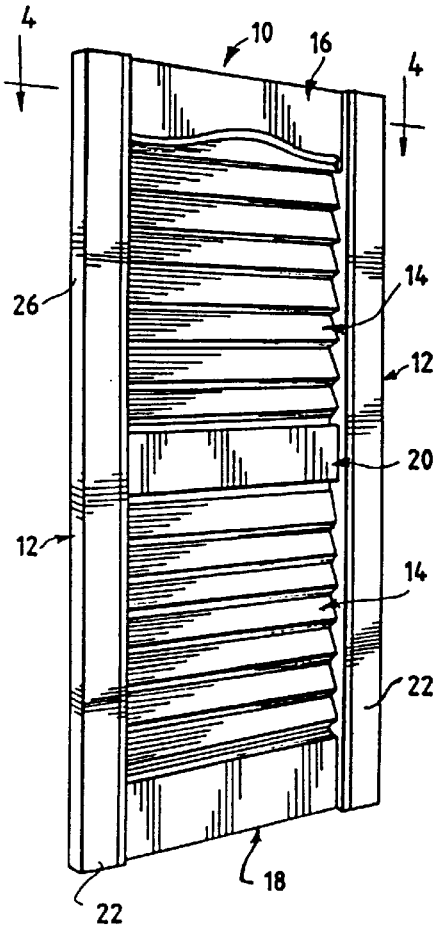
FIG. 1 is a perspective view of one embodiment of a fastenerless modular shutter which embodies the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
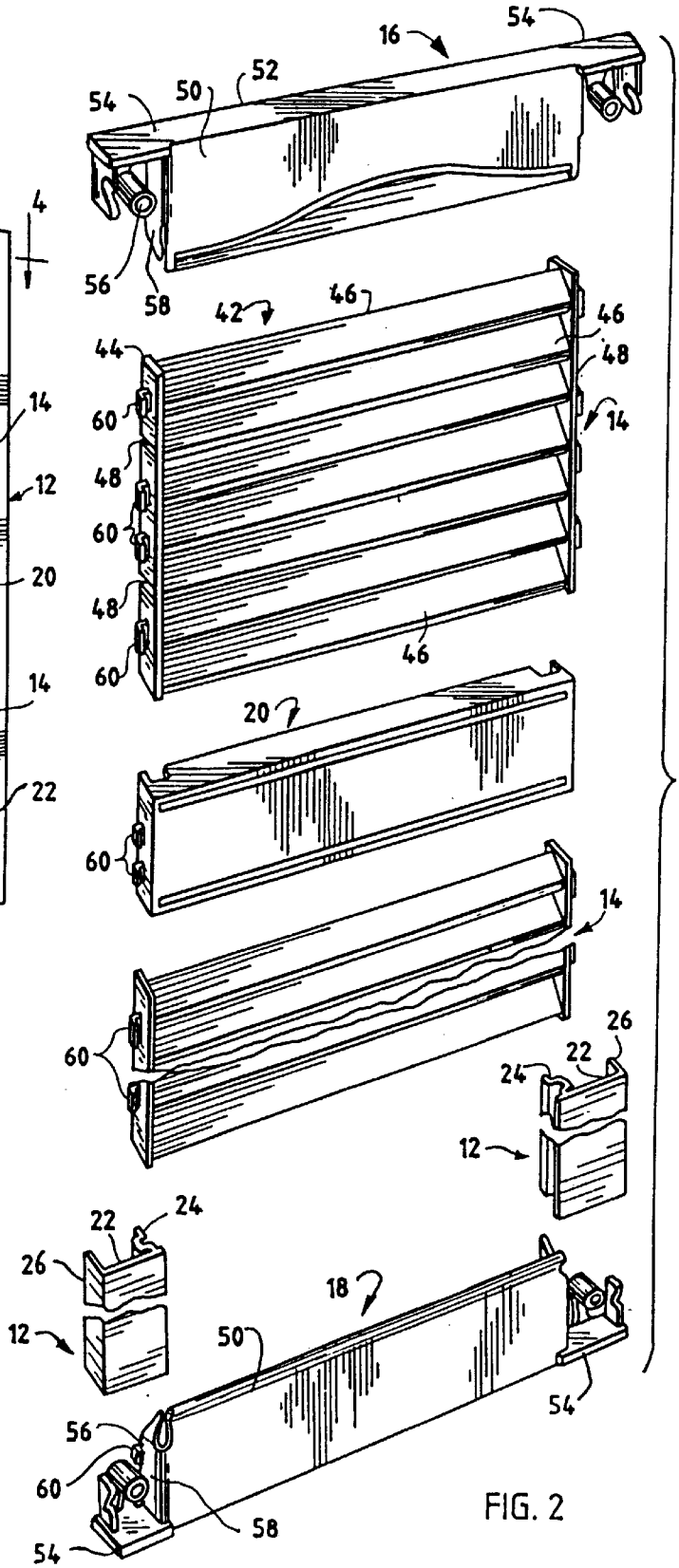
FIG. 2 is an enlarged, exploded, perspective view of the fastenerless modular shutter of FIG. 1.

There is shown in FIG. 1 a fastenerless modular shutter 10 comprising a pair of side rails 12, one or more shutter panel members 14, a top end rail 16, and a bottom end rail 18. When, as shown in FIGS. 1 and 2, the shutter 10 includes more than one panel member 14, one or more mullion or central rails 20 may be disposed between adjacent panel members 14. As used throughout the specification and claims, the term panel member shall mean either a louver panel member or a raised panel member.

Referring now to FIGS. 2 and 4, each side rail includes a front wall 22, an inner wall 24 and an outer wall 26, and is formed in a generally C-shaped cross section. In one embodiment, each rail 12 includes a track 28 which may include a hook portion 30 at an end 32 thereof. Each rail 12 may also include an offset retaining channel or slot 34 which interrupts the plane of the inner wall 24. Such a configuration is fully described in U.S. Pat. No. 5,524,407, issued on Jun. 11, 1996, which patent is commonly assigned herewith.

The offset retaining channel 34 may have any number of shapes, such as the exemplary L-shaped cross section, as best seen in FIGS. 2 and 4. The side rail 12 may also include a lip 36 extending from the front wall 22, inwardly relative to the shutter panel 14.

In an embodiment which includes the hook portion 30, serrations 40 (see FIG. 12*a*) may be formed in the side rail 12, at the hook portion 30 adjacent to the inner wall 24.

Each shutter panel 14 has a central portion 42 and includes a pair of runners or mounting flanges 44, which extend along opposite sides of the panel 14 and run the length thereof. The runners 44 are oriented generally transverse to the plane of the central portion 42.

The panel 14 may include a plurality of louvers 46 extending transverse to and between the runners 44, and score lines 48 in the runners 44 corresponding to selected locations between the louvers 46. The score lines 48 facilitate separation of the panels 14 into shorter lengths according to the requirements of the particular installation.

The top and bottom end rails or end caps, 16 and 18, respectively, are generally similarly formed. Each includes a front wall portion 50, and an end wall portion 52 formed adjacent and generally transverse thereto. The end wall 52 includes a pair of wing-like extensions 54 which extend from the ends thereof, a distance sufficient to engage or cover the side rails 12.

In the embodiments, shown generally in FIGS. 2–5 and 9–15, the end rails 16 and 18 each includes a locking portion 56 which extends along a runner portion 58. The runner 58 extends rearwardly from and transverse to the front wall 50. The locking portion 56 includes a first, wedge-like projection 60 (see FIGS. 3–5, 9–11, and 13–14), and/or a second, tine-like projection 62 (see FIGS. 10, 11, 12, and 12*a*).

The wedge-like member 60 includes a base leg portion 60*a* oriented generally transverse to the plane of the runner 58, and a free leg portion 60*b* oriented generally parallel to the plane of the runner 58 and spaced therefrom. The member 60 has a shape complementary to the shape of the retaining channel 34 of the side rail 12. The wedge-like member 60 is configured to interferingly, slidably engage the retaining channel 34 of the side rail 12 when the side rail 12 and end rail 16, 18 are assembled together.

The wedge-like projection 60 has a broadening or increasing cross section, traversing along the projection 60 toward the trailing end 64 thereof. The trailing end 64 is that portion of the projection 60 which last engages the retaining channel 34 when assembled.

The cross section may increase in a single plane in a direction transverse to the runner 58, as best illustrated in FIGS. 4 and 5. In this configuration, the wedge-like projection 60 coacts with inner walls 66 of the retaining channel 34 to interferingly engage the inner walls 66 and resist separation of the end rail 16, 18 from the side rail 12.

Alternately, the projection 60 may have a multi-plane increasing cross section, in directions transverse to and parallel with the runner 58, as shown in FIGS. 14–15. In this alternate configuration, the projection 60 engages the inner walls 66 in multiple directions.

The tine-like projection 62 extends rearwardly from the front wall 50, in lieu of a portion of the runner 58, in a plane generally parallel to the runner 58, and downwardly toward the end wall portion 52. The tine-like projection 62 engages the side rail 12 at the hook portion 30, while an opposite edge 68 of the locking portion 56 engages the lip 36 at the front wall 22. This provides a snug, frictional fit of the locking portion 56 into the track 28. Thus, the locking portion 56 acts as an interference member.

In one form of the tine-like projection 62, illustrated in FIG. 12, the tine-like projection 62 flexes or deflects as the end rail 16, 18 and the side rail 12 are engaged one with the other, in a direction indicated by the arrow at 70. The force of the tine-like projection 62 against the hook portion 30 resists separation of the end rail 16, 18 from the side rail 12, once engaged.

As illustrated in FIG. 12A, the side rail 12 may include serrations 40 therein at the hook portion 30 for engaging the tine-like projection 62.

Figure 9:
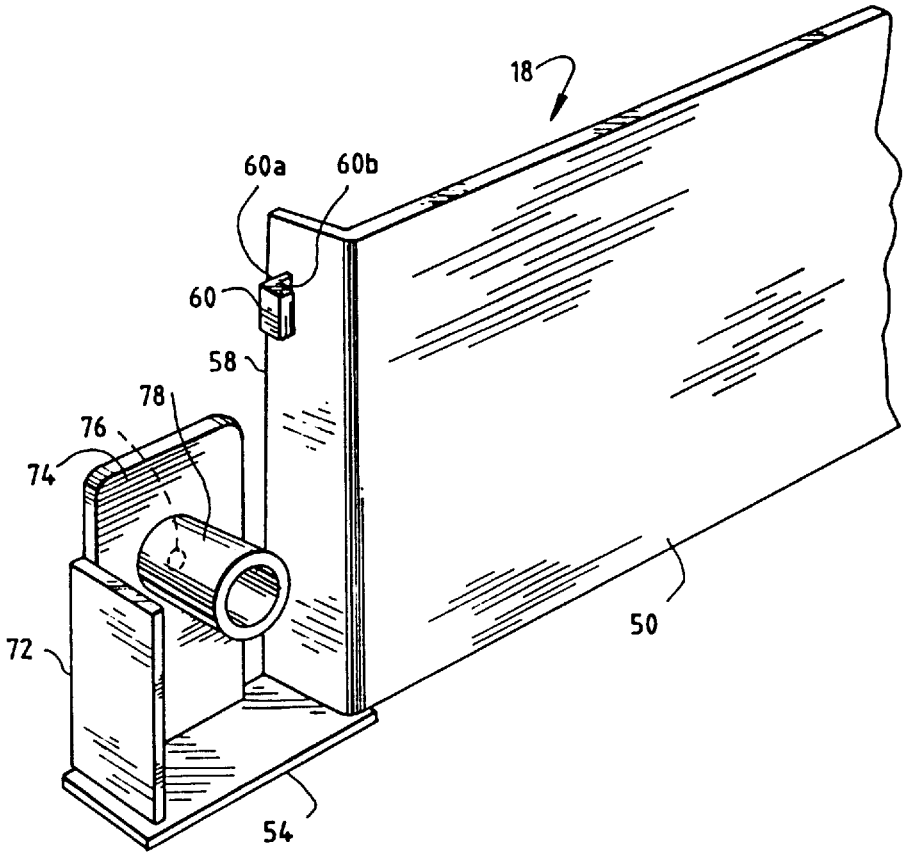
FIG. 9 is a perspective view of another embodiment of a representative top or bottom rail which embodies the principles of the present invention.

Referring now to FIGS. 3, 9 and 10, the end rails 16, 18 include a pair of aligning tabs 72 which depend from the wing-like extensions 54, and align the end rails 16, 18 with their associated side rails 12. The end rails 16, 18 also include mounting flanges 74 which depend from the wing-like extensions, and are oriented generally transverse to the aligning flanges.

The mounting flanges 74 may be positioned near the front of the end rail 16, 18, as illustrated in FIG. 10. Alternatively, the mounting flanges 74 may be positioned near the rear of the end rail 16, 18, as illustrated in FIGS. 3 and 9. In either the front or rear position, each flange 74 includes an opening 76 therein for receiving a screw or other fastener (not shown) for mounting the shutter to a support surface, for example, the wall of a building.

Optionally, the mounting flange 74 includes a support or spacing member 78 located thereon to provide proper spacing of the side rail front wall 22 from the building surface during fastening. The spacing member 78 also prevents or minimizes dimpling of the front wall 22 due to over-driving of the fastener. The spacing member 78 may take many different forms, such as the hollow tube as illustrated.

As shown in FIGS. 3 and 10, the flange 74 may be fully formed in, for example, a rectangular shape, or the flange 74 may be formed so as to minimize the use of materials while providing sufficient area for proper functioning of the flange 74. As shown in FIG. 3, the aligning tabs 72 may also be formed in a manner to minimize the amount of material used.

As shown in FIGS. 3 and 6–8, the end rails 16, 18 may also include an adjusting member to permit movement and retention of the shutter panel 14 relative to the side rails 12. The movement and retention feature permits adjusting the shutter panel 14 within the shutter 10, relative to the side rails 12 and/or the end rails 16, 18.

In known shutters, a gap may exist between the shutter panel and the top rail at the juncture thereof. This is due principally to the inability to "finely" adjust and maintain the position of the shutter panel within the shutter assembly, relative to the end rails. This gap between the shutter panel and the end rail detracts from the aesthetic appeal and overall character of the shutter.

The present invention provides such a "fine" adjustment capability for effecting optimal placement of the panel 14 within the shutter 10 assembly. The adjusting feature can be used to reduce or eliminate any gap which would otherwise exist between the shutter panel 14 and the top rail 16.

In one embodiment, the adjusting member includes a pair of adjusting tabs 80, a representative one of which is best shown in FIG. 3. For purposes of the present discussion, a description of the tab 80 will provided, as illustrated in the bottom rail 18, shown in FIG. 3. The adjusting tabs 80 are flexible, tapered members which extend from a base portion 82 adjacent to the runner 58, upwardly relative to the end wall portion 52, to form a leading portion 84.

FIGS. 6–8 illustrate the interaction between the adjusting tabs 80 and the shutter panel 14 in an assembled shutter 10. The side rail 12 has been removed for clarity of illustration. With the end rail 18 in place, the position of the shutter panel 14 can be finely adjusted relative to the end rail 18 by moving the shutter panel 14 toward and away from the end rail 18.

As the shutter panel 14 is moved toward the end rail 18, the runner 44 of the shutter panel 14 engages the leading portion 84 of the tab 80, which flexes, as illustrated in FIG. 7. As the runner 44 is moved further into engagement with the tab 80, the tab 80 flexes inwardly to accommodate the positioning of the panel 14, as shown in FIG. 8. The force exerted by the tab 80 on the runner 44 holds or retains the panel 14 in place in the shutter assembly 10.

Alternately, as shown in FIG. 10, the panel 14 can be retained within the shutter 10 by retaining blocks or abutments 86. The blocks 86 define an angled face 88 which angles upward and rearward, relative to the front wall 50. The blocks 86 function similar to the tabs 80, in so far as they permit positioning of the shutter panel 14 relative to the shutter assembly 10. The blocks 86, however, coact with the lower-most louver 46 of the panel 14, rather than the runners 44.

In the retaining block 86 configuration, the louver 46 flexes in response to engagement between the blocks 86 and the panel 14, to accommodate the desired positioning of the panel 14 therein. Once positioned, the panel 14 is held or retained in place in the shutter assembly 10 by the force exerted by the blocks 86 on the louver 46.

In either the tab 80 or block 86 configuration, the shutter panel 14 can be finely adjusted to a desired position within the shutter assembly 10 to effectuate optimal placement of the panel 14 within the shutter 10. Consequently, any gap which would otherwise exist between the shutter panel 14 and the top rail 16 can be reduced or eliminated.

Figure 16:
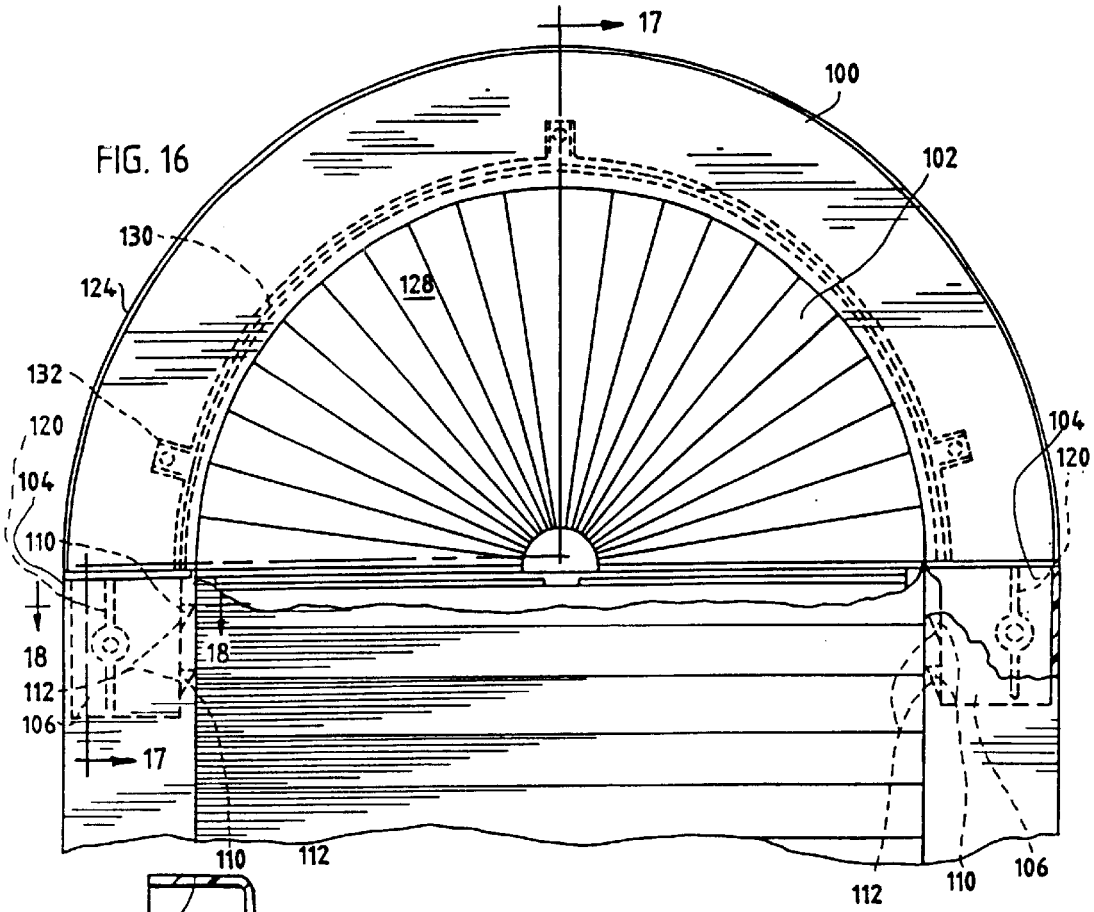
FIG. 16 is a front, elevational view of a semi-circular top rail illustrating another embodiment of the fastenerless modular shutter which embodies the principles of the present invention.
Figure 17:
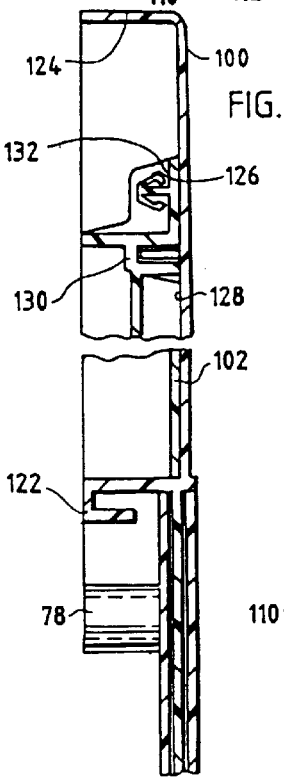
FIG. 17 is a cross-sectional view taken along line 17—17 of FIG. 16.
Figure 18:
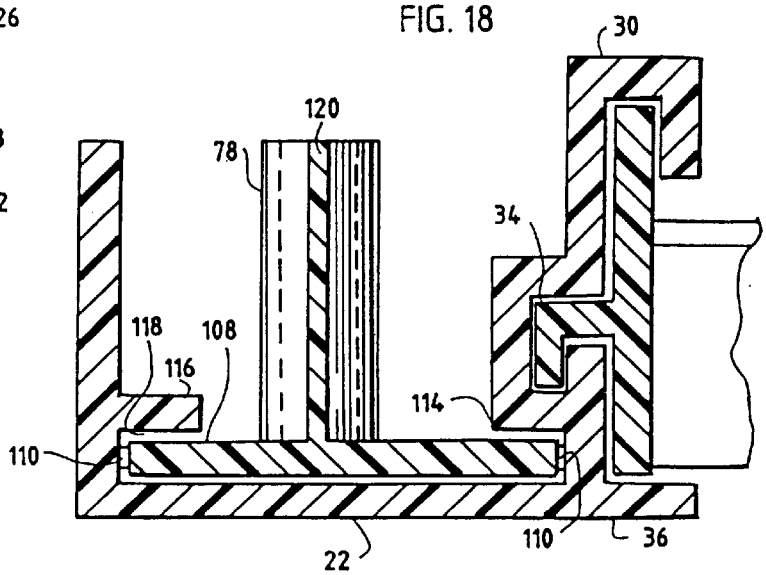
FIG. 18 is a sectional view taken along line 18—18 of FIG. 16.

Another alternate embodiment of the fastenerless shutter 10 is shown in FIGS. 16–18, with a top rail 100 having a semi-circular insert portion 102. It will be recognized that this embodiment of the top rail 100 can be used with other top rail shapes, such as the previously described rectangular top end rail 16. Thus, this top rail 100 is not limited to the semi-circular design shown and described herein.

The top rail 100 includes a pair of end portions 104 depending therefrom. Each end portion 104 includes a locking portion 106 which extends into the top of the side rail 12. The locking portions 106 each include a front wall 108. The front wall 108 has projections 110, which may be barbed, or otherwise angled, as shown at 112.

The barbed or angled portions 112 of the projections 110 permit "one-way" insertion of the locking portion 106 into the side rail 12. Once engaged, separation of the end rail 100 and the side rail 12 is resisted by the frictional force exerted by the barb on the inner and outer walls 24, 26, respectively, of the side rail 12.

The side rails 12 may include first and second lips 114, 116 interior thereto, at the inner and outer wall 24, 26, respectively, opposing each other. The lips 114 and 116 define a channel 118 for receiving the front wall 108. The channel 118 prevents torsional slippage and twisting of the front wall 108, within the side rail 12.

The end portions 104 may further include a support or spacing member 78 located thereon to provide proper spacing of the side rail front wall 22 from the surface of an associated building, while mounting the shutter 10 thereto. The spacing member 78 also prevents or minimizes dimpling of the front wall 22 due to over-driving the fastener. The spacing member 78 may take many different forms, such as the hollow tubular shape illustrated. As shown, the spacing member 78 may also include gussets 120 to provide additional rigidity to the overall structure.

The end rail 110 can be assembled with different, interchangeable patterns of inserts 102. The end rail includes a lower, lateral support flange 122 and an upper support flange 124. The upper support flange 124 includes mounting members, such as push pins 126, for mounting the insert thereto.

The insert 102 includes a central portion 128 which may have a pattern molded or formed therein, and a peripheral lip 130 for positioning and mounting the insert 102 to the upper support flange 124. The insert 102 has mounting flanges or tabs 132 for engaging the exemplary push pins 126.

Thus, there has been disclosed a modular shutter which includes frictionally, interferingly engaging members permit assembly of the shutter without extra fasteners, such as staples. The fastenerless shutter which incorporates side rails and end rails which are configured and interact to restrict and limit separation of the rails from each other prior to installation.

The shutter further includes an adjusting member which permits adjustment of the position of one or more panel members, and optionally, a mullion, relative to the end rails. The adjusting configuration eliminates the requirement of fasteners (i.e., staples) to hold the multiple panel members or mullions in place.

Figure 19:
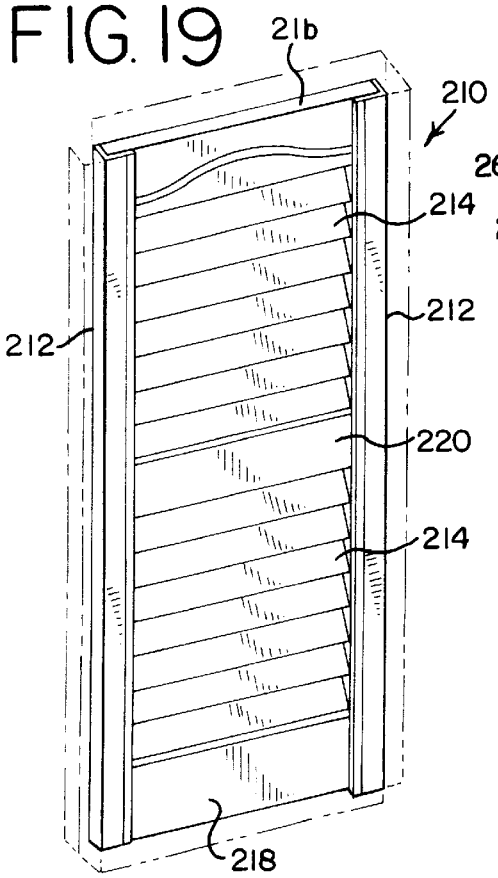
FIG. 19 is a perspective view of an embodiment of an adjustable, fastenerless modular shutter which embodies the principles of the present invention, which shutter is illustrated with side rails of two widths, the wider of the side rails being shown in phantom lines.
Figure 20:
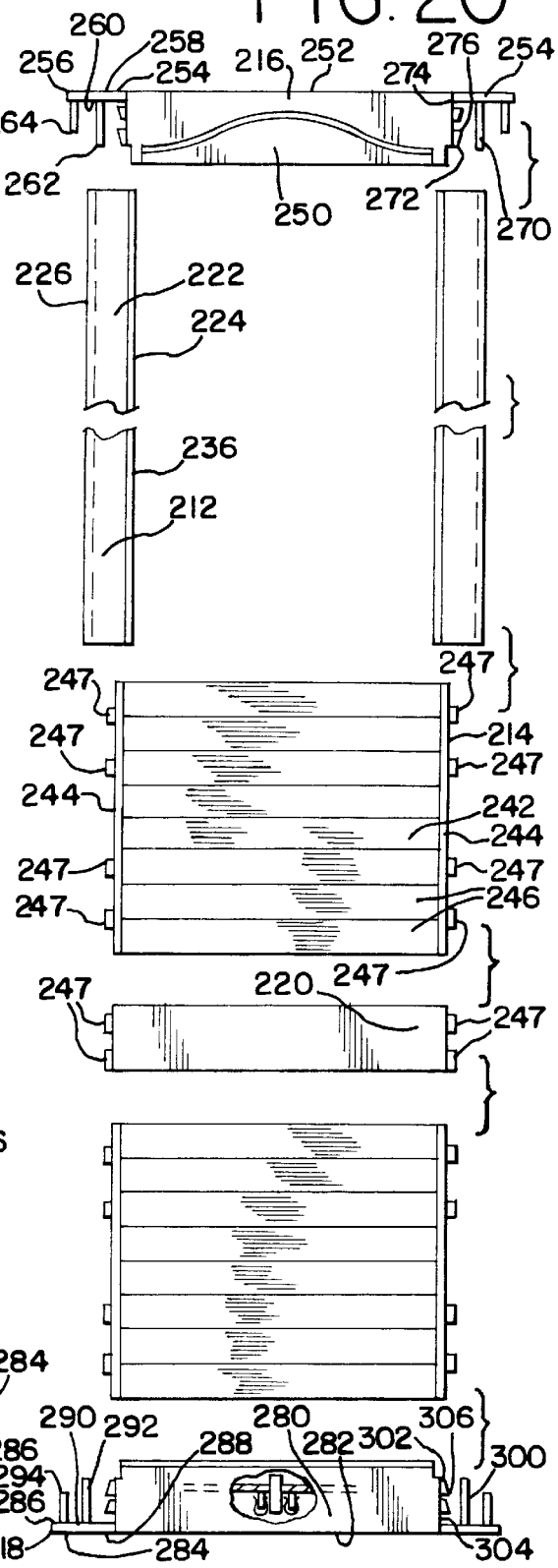
FIG. 20 is an enlarged, exploded, front view of the adjustable, fastenerless modular shutter of FIG. 19.
Figure 21:
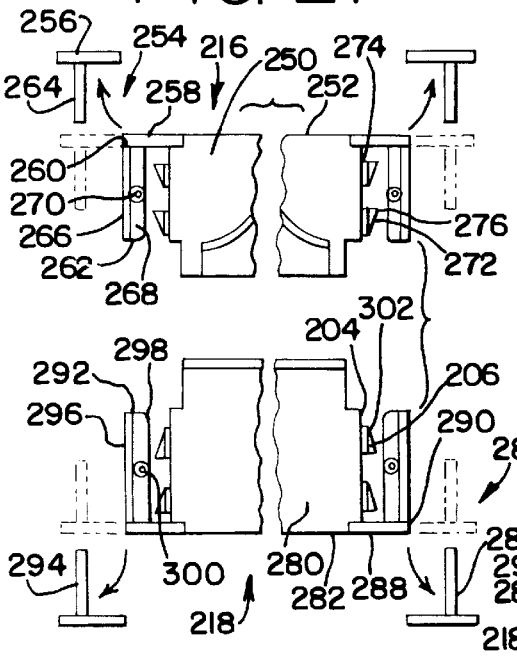
FIG. 21 is an enlarged, fragmentary, front view of representative top and bottom rails of the fastenerless modular shutter, illustrated with severable side wings of the rails which permit use with side rails of differing widths.

Referring to FIGS. 19–25, an adjustable, fastenerless modular shutter 210 is comprised of a pair of side rails 212, one or more shutter panel members 214, a top end rail 216, and a bottom end rail 218. When, as shown in FIGS. 19 and 20, the shutter 210 includes more than one panel member 214, a mullion or central rail 220 may be disposed between adjacent panel members 214. While the description below will refer to a single panel member for convenience of the description, it is to be understood that as used herein, the term panel member or panel encompasses one or more panel members, with or without mullions.

Figure 22:
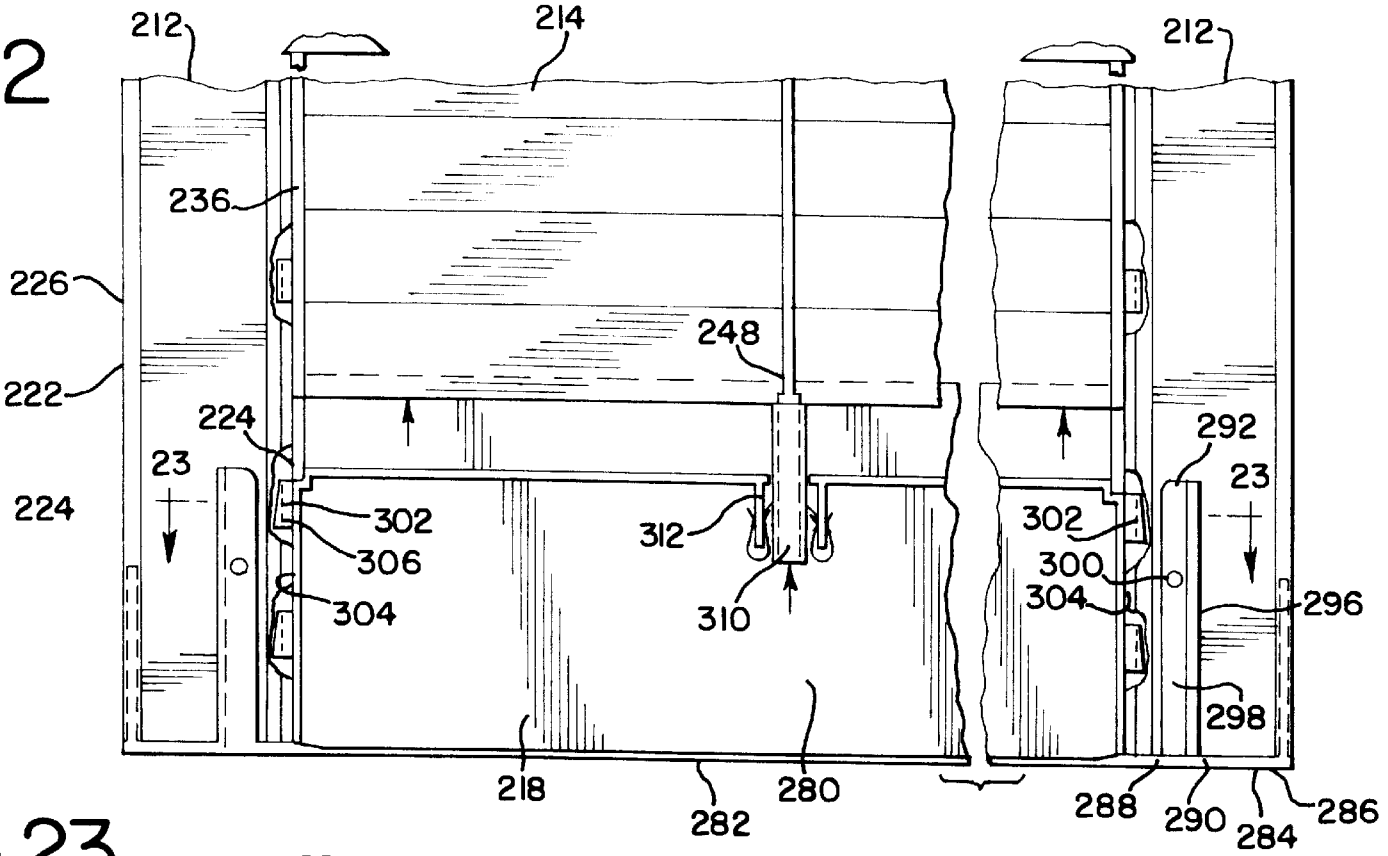
FIG. 22 is an enlarged, fragmentary, rear view of a representative bottom rail illustrating a slidable adjusting member for retaining a shutter panel member in a fixed position relative to the end wall of the shutter, and illustrated with the removable wings for accommodating side rails of various widths.

Referring now to FIGS. 20 and 22, each side rail includes a front wall 222, an inner wall 224 and an outer wall 226, and is formed in a generally C-shaped cross section. In one embodiment, each rail 212 includes a track 228 which may include a hook portion (not shown) at an end 232 thereof. Each rail 212 may also include an offset retaining channel or slot 234 which interrupts the plane of the inner wall 224. Such a configuration is fully described in U.S. Pat. No. 5,524,407, issued Jun. 11, 1996, which patent is commonly assigned and incorporated herein by reference.

Figure 23:
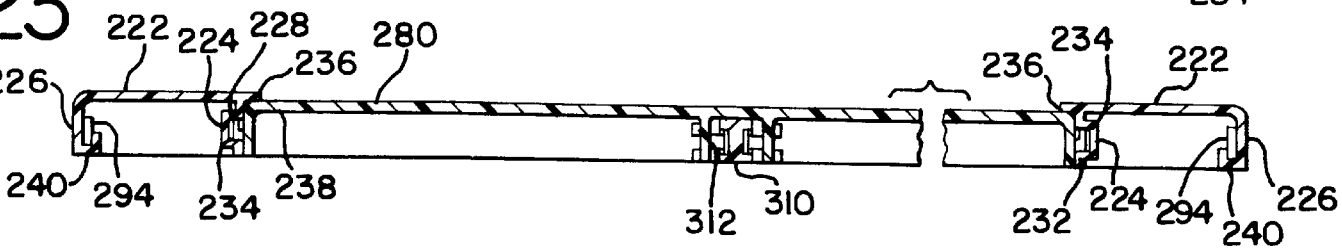
FIG. 23 is a cross-sectional view taken along line 23—23 of FIG. 22.

The offset retaining channel 234 may have any number of shapes, such as the exemplary L-shaped cross section best seen in FIG. 23. The side rail 212 may also include a lip 236 extending from the front wall 222, inwardly relative to the shutter panel 214, at an edge 238 thereof, adjacent the inner wall 224.

Figure 26:
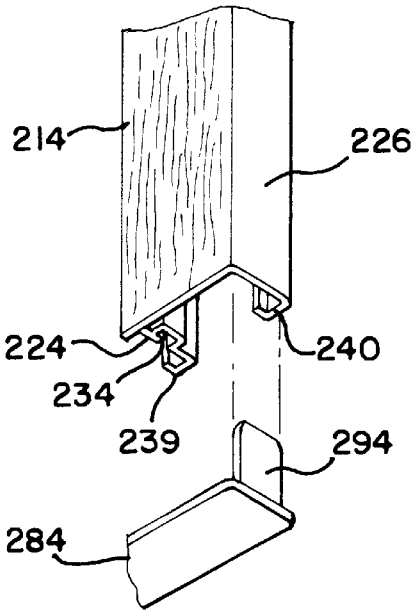
FIG. 26 is a partial perspective, exploded view of an alternate embodiment of the side rail having an outer wall hook portion and an end wall having a transverse bracing support for engagement with the hook portion.

In one embodiment, as illustrated in FIG. 26, the shutter 210 may include a hook portion 239 in the side rail 212 inner wall 224, opposite the lip 236, as disclosed in the aforementioned U.S. Pat. No. 5,524,407. Optionally, as illustrated in FIGS. 23 and 26, the side rail 212 may also include a hook portion 240 disposed at the rear of the outer wall 226, for additional rigidity in engagement of the side rails 212 to the end rails 216 and 218.

Each shutter panel 214 has a central portion 242 which terminates in ends 244 extending along opposite sides of the panel 214 and running the length thereof. In one embodiment, the ends 244 include runners or mounting flanges, which are oriented generally transverse to the plane of the central portion 242.

The panel 214 may include a plurality of louvers 246 extending transverse to and between the runners 244, and score lines (not shown) in the runners 244 corresponding to selected locations between the louvers 246. The score lines facilitate separation of the panels 214 into shorter lengths according to the requirements of the particular installation.

The panel 214 may also include projections 247 extending from the ends 244 thereof. The projections 247 have a cross-sectional shape which is complementary to the cross-sectional shape of the retaining channel 234 in the side rails 212. The projections 247 facilitate slidably engaging and retaining the panel 214 in engagement with the side rails 212. The projections 247 may also be formed on the ends of the mullion 220.

The top end rail or end cap 216 includes a front wall 250, and an end wall 252 formed adjacent and generally transverse thereto. The end wall 252 includes a pair of wing-like extensions 254 which extend from the ends thereof, a distance sufficient to engage or cover the side rails 212. The wings 254 include a severable or removable portion 256 which extends from a base portion 258 thereof so that the cap 216 can be used with side rails 212 of varying widths, as illustrated in FIG. 19. In a presently contemplated configuration, the end cap 216 with the removable wing-like portion 254 can be used with side rails 212 having different widths, such as, for example, widths of one inch and two inches. Of course, other width side rails can be configured for use in the shutter 210. In one embodiment, the removable portion 256 is removed from the base portion 258 along a score line 260.

The end cap 216 also includes first and second pairs of transversely extending support members 262 and 264, respectively, which coact with the one inch and two inch wide side rails 212. The support members 262, 264 extend into the side rails 212 of the assembled shutter 210 and provide additional support thereto. In one configuration, the first pair 262 of support members is generally L-shaped, with one leg 266 extending transverse to the plane of the shutter 210 and the other leg 268 extending parallel to the plane of the shutter 210, located toward the rear of the cap 216.

As illustrated in FIGS. 22, 23 and 26, the second pair 264 of support members may be configured to slidably engage the outer wall 226 of the side rail 212 at the hook portion 240. This configuration provides additional rigidity to the shutter 210 and provides positive engagement of the end caps 216 and 218 to the side rails 212. Advantageously, this configuration also prevents the side rails 212 from spreading or flaring during installation in the event that the fastener which fastens the shutter 210 to the building wall is over-torqued.

Each of the parallel legs 268 includes an opening 270 therein which can accommodate a fastener (not shown) to fasten the shutter 210 to the side of a building. Advantageously, the leg 268 and opening 270 configuration permits ready use of the assembled shutter 210 as a template for marking the shutter 210 and shutter installation location on the side of the building where the shutter is to be installed.

The end rail 216 includes a locking portion 272 which extends along an inner wall portion 274 thereof. The inner wall 274 extends rearwardly from and transverse to the front wall 250. In one embodiment, the locking portion 272 includes a wedge-like projection having a base leg portion 272*a* oriented generally transverse to the plane of the inner wall 274, and a free leg portion 272*b* oriented generally parallel to the plane of the wall 274 and spaced therefrom.

The projection 272 has a shape complementary to the shape of the retaining channel 234 of the side rail 212. The wedge-like member 272 is configured to interferingly, slidably engage the retaining channel 234 of the side rail 212 when the side rail 212 and end rail are assembled together.

In one embodiment, the wedge-like projection 272 has a broadening or increasing cross section, traversing along the projection 272 toward the trailing end 276 thereof. The trailing end 276 is that portion of the projection 272 which last engages the retaining channel 234 when assembled.

The cross section may increase in a single plane in a direction transverse to the inner wall 274. Alternately, the projection 272 may have a cross-section which increases in other planes, or a multi-plane increasing cross section, in directions transverse to and parallel with the inner wall 274.

The bottom end rail or end cap 218 is formed similar to the top cap 216, and includes a front wall 280, an end wall 282 and a pair of wing-like extensions 284. In one embodiment, the wings 284 include a severable or removable portion 286 extending from a base portion 288, which removable portion may be removed from the base portion along a score line 290.

The wings 284 may further include first and second pairs of transverse support members 292 and 294. Each of the first pair of members 292 includes a transverse support leg 296 and a parallel support leg 298, having a opening 300 therein to accommodate a fastener (not shown). Similar to the top end cap 216, the second pair 294 of support members may be configured to slidably engage the outer wall 226 of the side rail 212 at the hook portion 240.

Similar to the top cap 216, the bottom cap 218 includes an interference projection 302 extending from an inner wall 304 thereof. As described above, the projection 302 may have an increasing cross-section or cross-sections, increasing toward the trailing end 306 thereof.

In known shutters, a gap may exist between the shutter panel and the top rail when the shutter panel is assembled for the particular installation, when the side rails are cut to a desired length. This is primarily due to the inability to finely adjust and maintain the position of the louvered shutter panel within the assembly, relative to the side rails and top and bottom end rails. The gap between the shutter panel and the end rail detracts from the overall character and the aesthetic appeal of the shutter.

While the shutter assembly which is the subject of the aforementioned U.S. Pat. No. 5,524,407 is intended to solve this problem by use of flexible side members and/or a fixed abutment member in contact with the flexible louvers, the present invention solves this problem by use of a positive acting, rigidly abutting, adjustable support member directly acting upon the shutter panel.

The adjustable support member configuration provides a positive retention of the panel member in place, without the need for predetermined flexure of any shutter parts for resiliently supporting other parts of the shutter. The present adjusting feature advantageously provides the ability to finely adjust the position of the shutter panel relative to the side rails 212 and the top and bottom caps 216, 218, while providing a direct engagement of the shutter panel 214 without reliance upon flexure of parts of the end caps 216, 218 or shutter panel 214.

In an embodiment of the shutter 210, at least one of the top and the bottom cap 216, 218 includes a slidable adjusting member 310 thereon to permit movement, positioning and retention of the shutter panel member or members 214 relative to the side rails 212 and the top and bottom caps 216, 218. A description of the adjusting member 310 will provided in the context of the bottom cap 218. However, it will be appreciated that the adjusting member 310 may also be configured for use with the top cap 216 as well as mullion 220. Such description is not to be construed as a limitation upon the present invention, but as an exemplification with the understanding that the present discussion applies to the adjusting member being located on any or all of the top cap 216, the bottom cap 218 or the mullion 220.

Figure 24:
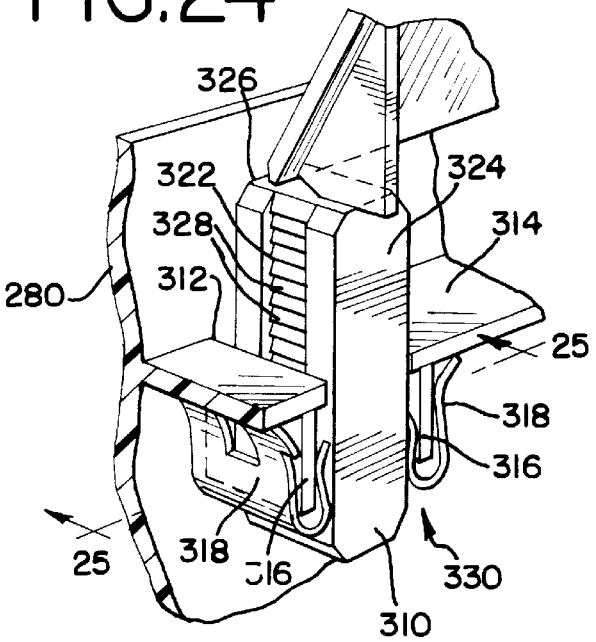
FIG. 24 partial perspective view of the slidable adjusting member positioned in an adjustment member support, and shown in engagement with a shutter panel member to retain the panel in a fixed position relative to the end wall of the shutter.

As best illustrated in FIG. 24, the adjusting member 310 may be positioned in an adjustment support portion 312 of the cap 218, formed, at least in part, from a rear transverse wall 314 of the cap 218. The support portion includes a pair of guide walls 316 which extend from the transverse wall 314. The support portion is adapted to slidably receive the adjusting member 310 therein and to permit the adjusting member to slide unidirectionally.

In a preferred embodiment, the guide walls are configured to receive locking elements 318, which in one configuration include spring bias clips which are frictionally positioned on the guide walls 316 and include a detent portion 320. The detent portion 320 is adapted to engage the adjusting member 310 and permit unidirectional movement of the adjusting member 310, toward the panel member 214 and away from the end wall 282.

Figure 25:
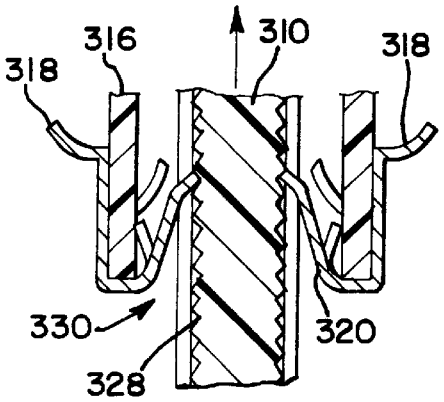
FIG. 25 is a cross-sectional view taken along line 25—25 of FIG. 24.

The adjusting member 310 shown in FIGS. 24 and 25 includes channels 322 defined by front and rear walls 324 and 326, which extend along the length thereof. In the illustrated embodiment, the channel 322 includes serrations 328 which coact with the detent portion 320 to permit the unidirectional movement. As will be recognized, the open channels 322 permit the adjusting member to be moved fully inward toward the panel member 214 and removed, if necessary, to reset the adjusting member in the entering end 330 of the support portion 312.

In use, the shutter 210 can be fully assembled prior to installation. The side rails can be assembled together with an end cap, for example, the top end cap 216. The panel 214 is positioned between the side rails 212, abutting end cap 216. The other, i.e., bottom end cap 218 is positioned abutting the panel 214. By abutting the adjustment member 310 against the panel 214, the position of the panel 214 relative to side rails 212 and the end caps 216 and 218 is fixed, and is positioned accordingly to eliminate any gaps between the panel 214 and the end caps 216 and 218.

In a preferred embodiment, the panel 214 includes a rib member 248 with which the adjusting member 310 can be directly engaged. If the adjusting member is moved too far inward toward the panel member 214, it can be removed and reset into the entering portion 330 of the support portion 312.

Thus, there has been disclosed an adjustable, modular shutter which includes frictionally, interferingly engaging members to permit assembly of the shutter without extra fasteners, such as staples. The modular shutter further includes an adjustable panel support member to selectively position and adjust one or more panel members, and optionally a mullion, relative to the side rails and end caps. The adjustable panel support member employs positive, rigidly abutting engagement of the support member to the panel member or members.

Referring to FIGS. 27–40, an alternative embodiment of an adjustable, fastenerless modular shutter 410 in accordance with the invention comprises a pair of side rails 412, one or more shutter panel members 414, a top end rail (not shown) and a bottom end rail 418. When the shutter 410 includes more than one panel member 414, a mullion(s) or central rail(s) (not shown) may be disposed between adjacent panel members 414. While the description below will refer to a single panel member for convenience of the description, it is to be understood that as used herein, the term panel encompasses one or more panel members, with or without mullions.

Figure 28:
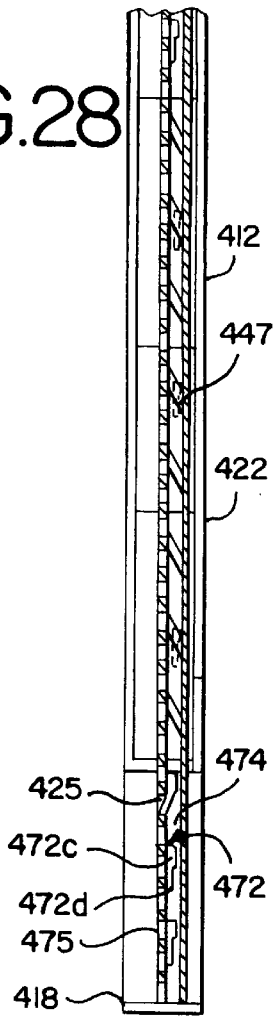
FIG. 28 is a cross-sectional view taken along line 28—28 of FIG. 27.
Figure 27:
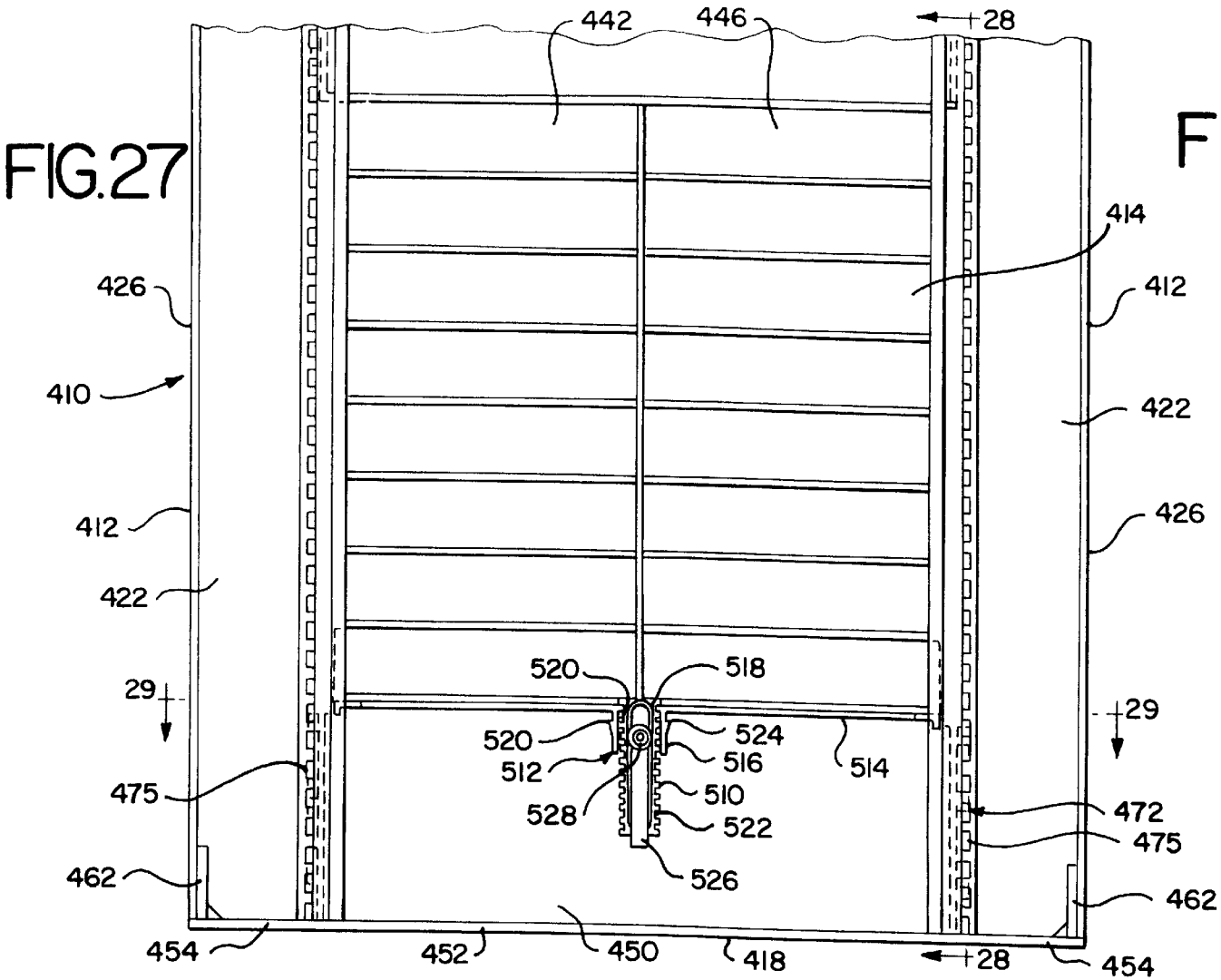
FIG. 27 is a fragmentary rear view of an alternative embodiment of an adjustable, fastenerless modular shutter in accordance with the invention.
Figure 29:
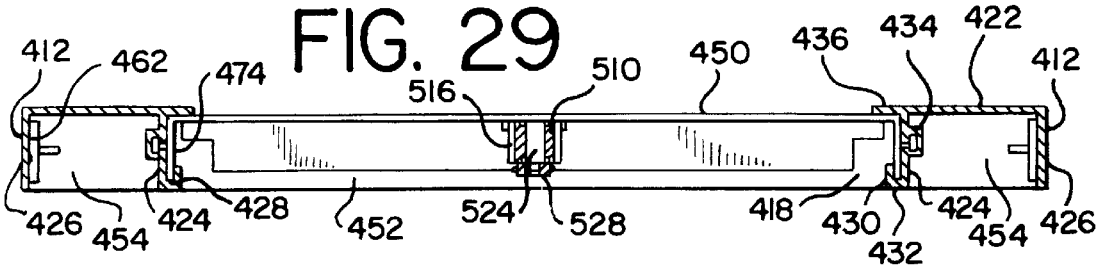
FIG. 29 is a cross-sectional view taken along line 29—29 of FIG. 27.

Referring now to FIGS. 27–29, each side rail includes a front wall 422, an inner wall 424 and an outer wall 426, and is formed in a generally C-shaped cross-section. In one embodiment, each rail 412 includes a track 428 which may include a hook portion 430 at an end 432 thereof. Each rail 412 may also include an offset retaining channel or slot 434 which interrupts the plane of the inner wall 424. Such a configuration is fully described in U.S. Pat. No. 5,524,407, issued Jun. 11, 1996, which patent is commonly assigned and incorporated herein by reference.

Figure 40:
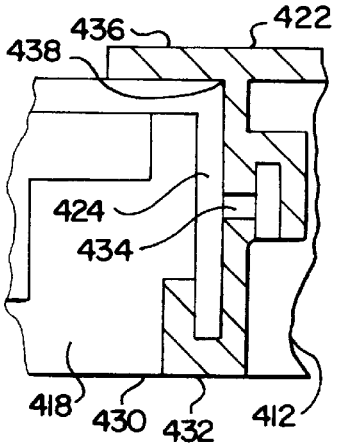
FIG. 40 is an enlarged, fragmentary, sectional view of the interconnection of the bottom rail to the side rail as shown in FIG. 29.

The offset retaining channel 434 may have any number of shapes, such as the exemplary L-shaped cross-section best seen in FIG. 40. The side rail 412 may also include a lip 436 extending from the front wall 422, inwardly relative to the shutter panel 414, at an edge 438 thereof, adjacent the inner wall 424.

In one embodiment, as illustrated in FIG. 40, the shutter 410 includes a hook portion 430 in the side rail 412 inner wall 424, opposite the lip 436, as described in the aforementioned U.S. Pat. No. 5,524,407.

Each shutter panel 414 has a central portion 442 which terminates in ends extending along the opposite side of the panel 414 and running the length thereof. In one embodiment, the ends include runner or mounting flanges, which are oriented generally transverse to the plane of the central portion 442.

The panel 414 may include a plurality of louvers 446 extending transverse to and between the runners 444, and score lines (not shown) in the runners 444 corresponding to selected locations between the louvers 446. The score lines facilitate separation of the panels 414 into shorter lengths according to the requirements of the particular installation.

The panel 414 may also include a plurality of longitudinally spaced apart projections 447 extending from the ends or runners 444 thereof. The projections 447 have a cross-sectional shape which is complimentary to the cross-sectional shape of the retaining channel 434 in the side rails 412. The projections 447 facilitate slidably engaging and retaining the panel 414 in engagement with the side rails 412.

The bottom end rail or end cap 418 includes a front wall 450, and an end wall 452 formed adjacent and generally transverse thereto. The end wall 452 includes a pair of wing-like extensions 454 which extend from the ends thereof, a distance sufficient to engage or cover the side rails 412. The end cap 418 includes a pair of transversely extending support members 462 which extend into the corresponding side rails 412 of the assembled shutter 410 and provide additional support thereto.

Figure 38:
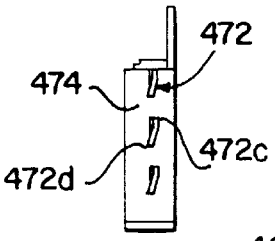
FIG. 38 is a fragmentary side elevational view of the bottom rail of FIG. 36.
Figure 39:
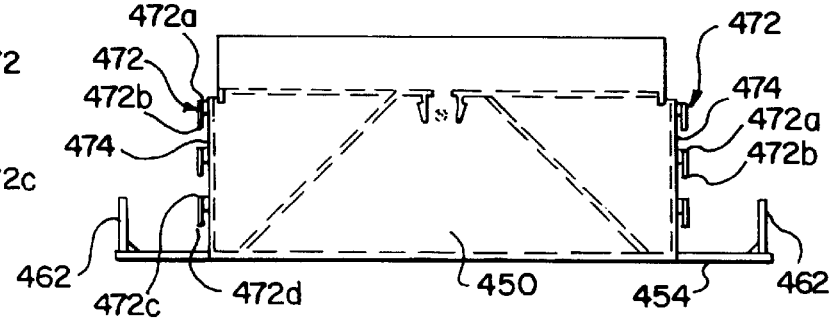
FIG. 39 is a front elevational view of the bottom rail of FIG. 36.

The end rail 418 includes a locking portion 472 which extends along an inner wall or runner portion 474. The inner wall or runner 474 extends rearwardly from and transverse to the front wall 450. In one embodiment, the locking portion 472 includes a plurality of longitudinally spaced apart projections having a base leg portion 472*a* oriented generally transverse to the plane of the inner wall 474 and a free leg portion 472*b* oriented generally parallel to the plane of the wall 474 and spaced therefrom. The projections 472 have a shape complimentary to the shape of the retaining channel 434 of the side rail 412. The free leg portion 472*b* has a proximal end segment 472*c* which is formed integral with the base leg portion and a distal end segment 472*d* that is inclined slightly inwardly, as best seen in FIG. 38. The distal end segment 472*d* is able to flex outwardly upon application of an outward force thereto.

Figure 30:
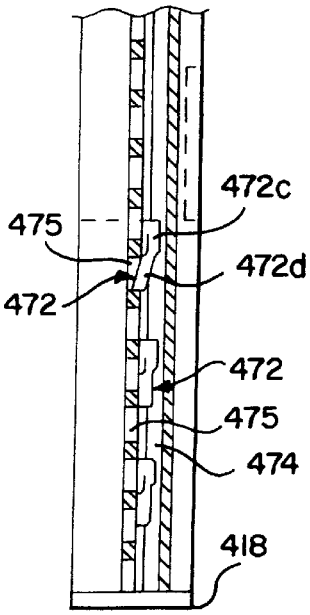
FIGS. 30–32 are enlarged sectional views taken through the side rail similar to FIG. 28 illustrating alternative engagements between the side rail and the end rail.
Figure 31:
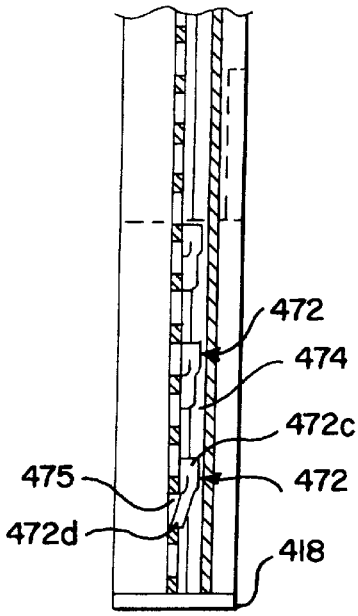
Figure 32:
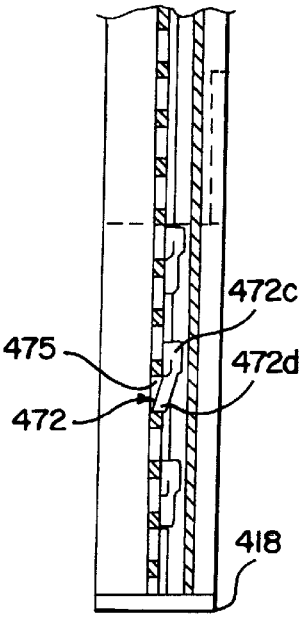

The offset retaining channel 434 is provided with a plurality of longitudinally spaced elongated openings 475 formed therein, preferably along the entire length of the side rail 412. The openings 475 are formed in the same longitudinal plane as the projections 472 so that as the bottom rail 418 is moved into position relative to the side rails 412, the distal end segments 472*d* are free to flex and move into and out of the openings 475. Referring to FIGS. 30–32, depending upon where the side rails 412 are cut to achieve a particular shutter length dimension, one of the end segments 472*d* is in engagement with an opening 475 so as to resist disengagement of the bottom rail from the side rails.

Although not shown, the top end rail and any mullions may be similarly provided with a locking portion 472 to secure these components in place relative to the side rails.

Figure 41:
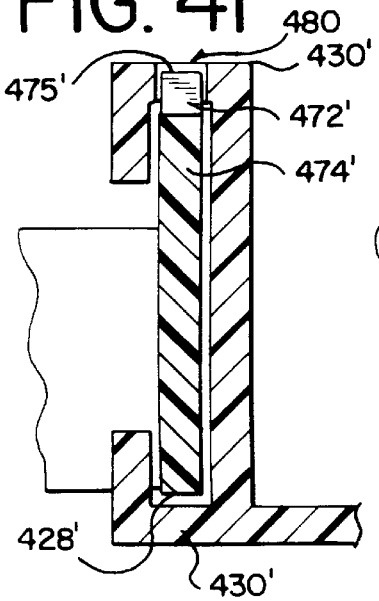
FIGS. 41–43 are enlarged, fragmentary, sectional views similar to FIG. 40 respectively showing alternative embodiments of the invention.
Figure 42:
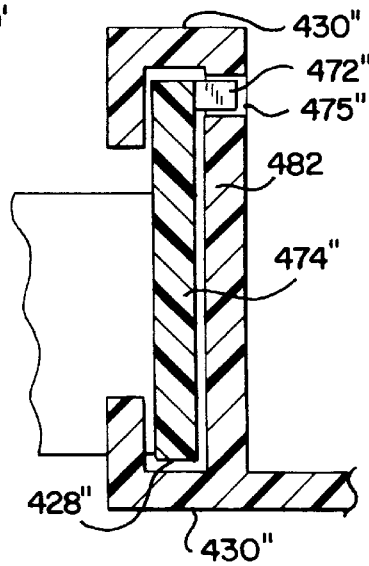
Figure 43:
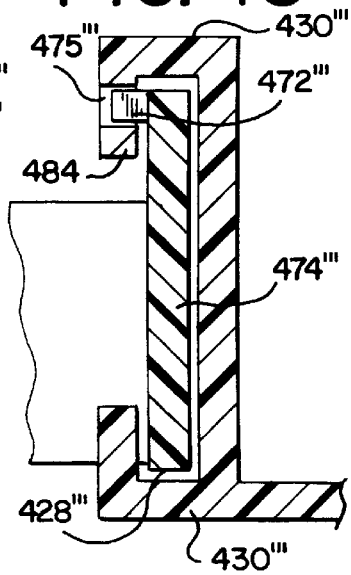

Referring to FIGS. 41–43, there is further shown alternative embodiments of the invention. More specifically, these alternative embodiments reflect alternative configurations of the track associated with the side rail and the locking portion associated with the runner portion of the end rails. In order to facilitate the disclosure, the elements of the embodiments as shown in FIGS. 41–43 that correspond to the elements in the above discussed shutter 410 shall be identified by same reference numerals followed by a single prime sign (FIG. 41), a double prime sign (FIG. 42) and a triple prime sign (FIG. 43).

Referring to FIG. 41, the track 428' may include a hook portion 430' at both ends thereof and the openings 475' extend through one of the end wall portions 480 of the hook portions. The runner portion 474' is provided with corresponding locking portions 472' which extend into the openings 475'.

Referring to FIG. 42, the track 428" may include a hook portion 439" at both ends thereof. The openings 475" extend through inner wall portions 482 of the track 428". The runner portion 474" is provided with corresponding locking portions 472" which extend into the openings 475".

Referring to FIG. 43, the track 428'"may include a hook portion 430'"at both ends thereof and the openings 475'"extend through one of the side wall portions 484 of the hook portions. The runner 474'"is provided with corresponding locking portions 472'" which extend into the openings 475'".

In known shutters, a gap may exist between the shutter panel and the top rail when the shutter panel is assembled for the particular installation, when the side rails are cut to a desired length. This is primarily due to the inability to finely adjust and maintain the position of the louvered shutter panel within the assembly, relative to the side rails and top and bottom end rails. The gap between the shutter panel and the end rail detracts from the overall character and the aesthetic appeal of the shutter.

While the shutter assembly which is the subject of U.S. Pat. No. 5,524,407 is intended to solve this problem by use of flexible side members and/or a fixed abutment member in contact with the flexible louvers, the present invention solves this problem by use of a positive acting, rigidly abutting, adjustable support member directly acting upon the shutter panel.

The adjustable support member configuration of the present invention provides a positive retention of the panel member in place and permits adjustment of the shutter panel relative to the side rails and the top and bottom end caps.

Referring to FIGS. 27 and 33–35, in an embodiment of the shutter 410, at least one of the top and the bottom end caps (bottom end cap 418 shown) includes an adjusting member 510 thereon to permit movement, positioning and retention of the shutter panel member or member 414 relative to the side rails 412 and the top and bottom end caps. A description of the adjusting member 510 will be provided in the context of the bottom cap 418. However, it will be appreciated that the adjusting member 510 may also be configured for use with the top cap as well as a mullion.

Figure 36:
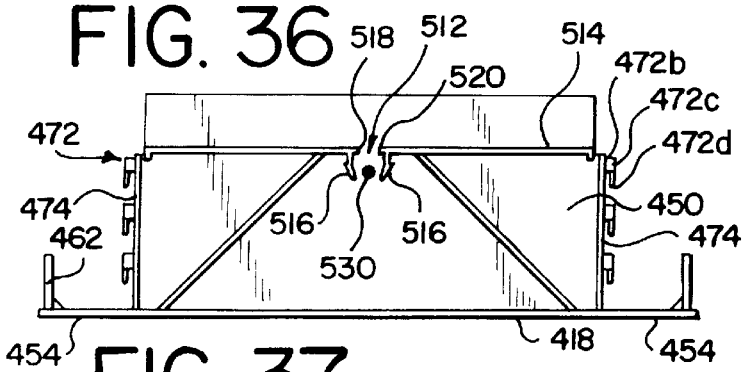
FIG. 36 is a rear elevational view of the bottom rail of the embodiment in FIG. 27.
Figure 37:
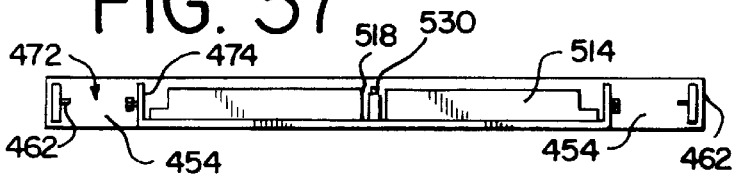
FIG. 37 is a top plan view of the bottom rail of FIG. 36.

As seen in FIGS. 27, 36 and 37, the adjusting member 510 may be positioned in an adjustment support portion 512 of the end cap 418, formed, at least in part, from a rear transverse wall 514 of the end cap 418. The support portion includes a pair of guide walls 516 which extend from the transverse wall 514. The support portion is adapted to receive the adjusting member 510 therein and to permit the adjusting member to be selectively positioned with respect thereto.

In a preferred embodiment, the transverse wall 514 has an opening 518 formed therein and the guide walls 516 extend therefrom so as to define inward projections 520.

Figure 33:
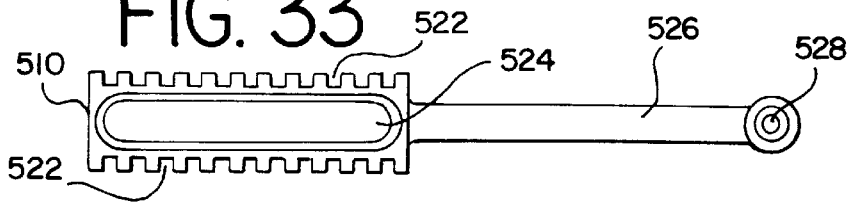
FIG. 33 is a top plan view of the adjusting member.
Figure 34:
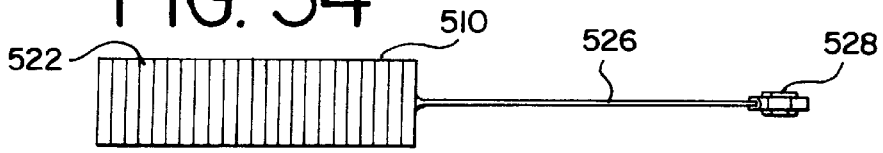
FIG. 34 is a side elevational view of the adjusting member.
Figure 35:
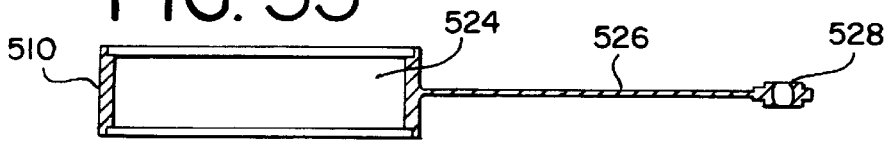
FIG. 35 is a cross-sectional view taken along line 35—35 of FIG. 33.

As best seen in FIGS. 33–35, the adjusting member 510 is a generally rectangular block having a plurality of spaced apart grooves 522 formed in opposing surfaces thereof. The grooves 522 are dimensioned to receive the projections 520 therein. Member 510 is formed with an elongated central opening 524 formed therein. An attachment strap 526 is attached at one end thereof to an end portion of the member 510. The other end of the strap has a snap portion 528 associated therewith. A button member 530 extends outwardly from the rear surface of the front wall 450 between the guide walls 516.

In use, the shutter 510 can be fully assembled prior to installation. The side rails can be assembled together with an end cap, for example, the top end cap. The panel 514 is positioned between the side rails 512, abutting the end cap. The bottom end cap 518 is positioned abutting the panel 514. The adjustment member 510 is positioned between the guide walls 516 so that the projections 520 are received in the corresponding grooves 522. The adjustment member 510 is positioned between the guide walls 516 so that it abuts against the panel 514. In so doing, the position of the panel 514 relative to side rails 512 and the end caps is fixed to eliminate any gaps between the panel 514 and the end caps. The strap 526 may then be folded and the snap portion 528 secured to the button member 530 that extends through the opening 524. In so doing, the adjustment member 510 is attached to the end cap 518.

Thus, there has been disclosed an adjustable, modular shutter which includes a positive engagement of the members to permit assembly of the shutter without extra fasteners, such as staples. The modular shutter further includes an adjustable panel support member to selectively position and adjust one or more panel members, and optionally a mullion, relative to the side rails and end caps. The support member employs positive, rigidly abutting engagement of the support member to the panel member or members. The support member is secured to one of the end caps.

What is claimed is:

1. A fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of runner portions disposed along the sides thereof, said runner portions being oriented generally parallel to said inner walls of said side rails, each of said runner portions engaging an associated side rail to secure said panel member to each of said side rails; and said end rails having an end wall portion, and including a pair of locking portions slidably received in an associated side rail, each said locking portion including at least one interferingly, frictionally engaging projection engaging with its said associated side rail to resist disengagement of said end rails from said side rails.

2. The fastenerless modular shutter as claimed in claim 1, wherein said end rails include a front wall, said end wall portions being oriented transverse to said front wall and extending rearwardly therefrom and including a runner portion slidably received in its said associated side rail, said end rail projection being formed in said runner portion for frictionally engaging said inner wall of said side rail to resist disengagement of said end rails from said side rails.

3. The fastenerless modular shutter as claimed in claim 2, wherein said side rail defines a track defined in part by a hook portion formed at an edge thereof, said end rail projection including a pointed end portion engaging said hook portion for resisting separation of said end rail from its associated side rails.

4. The fastenerless modular shutter as claimed in claim 3, wherein said pointed end portion flexes in response to engagement with said hook portion for resisting separation of said end rail from its associated side rails.

5. The fastenerless modular shutter as claimed in claim 3, wherein the inner wall of said side rail is formed to coact with said pointed end portion to provide resistance against separation of said end rail from its associated side rails.

6. The fastenerless modular shutter as claimed in claim 1, wherein said side rail further defines a retaining channel formed therein, at least a portion of said retaining channel being offset from a plane of the inner wall, said end rail projection acts as an interference member having a shape which is complementary to the shape of said retaining channel and being configured for interferingly, slidably engaging said retaining channel for resisting separation of said end rail from its associated side rails.

7. The fastenerless modular shutter as claimed in claim 6, said projection having an increasing cross-section.

8. The fastenerless modular shutter as claimed in claim 6, wherein at least one of said end rails further includes an adjusting member for adjustably engaging said panel member for permitting relative positioning and retention of said panel member to one of said end rails.

9. The fastenerless modular shutter as claimed in claim 7, said projection having a single-plane increasing cross-section.

10. The fastenerless modular shutter as claimed in claim 7, said projection having a multi-plane increasing cross-section.

11. The fastenerless modular shutter as claimed in claim 1, wherein said locking portion depends from said end wall portion and forms an insert receivable in said side rail, said projections extending outwardly therefrom, engaging at least said inner wall of said side rail.

12. A fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of runner portions disposed along the sides thereof, said runner portions being oriented generally parallel to said inner walls of said side rails, each of said runner portions engaging with an associated side rail and securing said panel member to each of said side rails; and said end rails each having an end wall portion, and including a pair of locking portions slidably received in an associated side rail, each said locking portion including at least one interference member frictionally engaging with its said associated side rail to resist disengagement of said end rails from said side rails.

13. The fastenerless modular shutter as claimed in claim 12, wherein said interference member extends generally coplanar with said plane of said side rail.

14. The fastenerless modular shutter as claimed in claim 12, wherein said interference member extends generally transverse to said plane of said side rail.

15. The fastenerless modular shutter as claimed in claim 12, wherein said interference member engages said side rail along an outer portion thereof.

16. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of runner portions disposed along the sides thereof, said runner portions being oriented generally parallel to said inner walls of said side rails, each of the runner portions being slidably received in an associated side rail to secure said panel member to each of said side rails;

said end rails having an end wall portion, and including a pair of locking portions slidably received in an associated side rail, each said locking portion including at least one interference member frictionally engaging its said associated side rail to resist disengagement of said end rails from said side rails; and at least one of said end rails further including an adjusting member for adjustably engaging said panel member for permitting relative positioning and retention of said panel member to one of said end rails.

17. The adjustable, fastenerless modular shutter as claimed in claim 16, said adjusting member including a pair of flexible, angular tab-like portions extending from said locking portion, transverse to said end wall portion, said tab-like portions engaging said runner portion of said panel member.

18. The adjustable, fastenerless modular shutter as claimed in claim 16, wherein said adjusting member includes at least one abutment having an angular face formed thereon, said abutment coacting with said central panel member, intermediate said runner portions.

19. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of runner portions disposed along the sides thereof, said runner portions being oriented generally parallel to said inner walls of said side rails, each of the runner portions being slidably received, in an associated side rail to secure said panel member to each of said side rails;

said end rails having an end wall portion, and including a pair of locking portions slidably received in an associated side rail, each said locking portion including at least one interference member frictionally engaging its said associated side rail to resist disengagement of said end rails from said side rails; and a slidable adjusting member slidably engaged with at least one of said end rails so as to adjustably engage said panel member to position and retain said panel member relative to one of said end rails.

20. The adjustable, fastenerless modular shutter of claim 19, wherein said at least one end rail includes an adjustment support portion that slidably receives said adjusting member for unidirectional movement of said adjusting member toward said panel member.

21. The adjustable, fastenerless modular shutter of claim 20 further including a pair of guide walls extending from said adjustment support portion, said guide walls engaging said adjusting member.

22. The adjustable, fastenerless modular shutter of claim 21 further including engaging members disposed at about said guide walls thereby engaging said adjusting member.

23. The adjustable, fastenerless modular shutter of claim 22, wherein said adjustment member includes locking elements thereon coacting with said engaging members securing said adjusting member relative to said end wall portion of said end rail.

24. The adjustable, fastenerless modular shutter of claim 23, wherein said locking elements permit movement of said adjusting member away from said end wall portion and toward said panel member.

25. The adjustable, fastenerless modular shutter of claim 23, wherein said adjusting member includes serrations thereon coacting with said engaging members.

26. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of end portions disposed along the sides thereof, said end portions being oriented generally parallel to said inner walls of said side rails, each of the end portions being received in an associated side rail to secure said panel member to each of said side rails;

said end rails having an end wall portion, and including a pair of locking portions slidably received in an associated side rail, each said locking portion including at least one interference member frictionally engaging its said associated side rail to resist disengagement of said end rails from said side rails; and a slidable adjusting member slidably engaged with at least one of said end rails to engage said panel member and position and retain said panel member against the other of said end rails.

27. The adjustable, fastenerless modular shutter of claim 26, wherein said at least one end rail includes an adjustment support portion including a pair of guide walls extending therefrom, said guide walls slidably receive said adjusting member.

28. The adjustable, fastenerless modular shutter of claim 27 further including engaging members disposed at about said support portion to engage said adjusting member.

29. The adjustable, fastenerless modular shutter of claim 28, wherein said adjustment member includes locking elements thereon that coact with said engaging members securing said adjusting member relative to said support portion.

30. The adjustable, fastenerless modular shutter of claim 29, wherein said locking elements permit unidirectional movement of said adjusting member relative to said end wall portion.

31. The adjustable, fastenerless modular shutter of claim 30, wherein said adjusting member includes serrations thereon that coact with said engaging members.

32. The adjustable, fastenerless modular shutter of claim 31, wherein said adjusting member defines a channel formed therein.

33. The adjustable, fastenerless modular shutter of claim 32, wherein said locking elements are formed in said channel.

34. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of end portions disposed along the sides thereof, said end portions being oriented generally parallel to said inner walls of said side rails, each of the end portions being received in an associated side rail engaging said panel member with each of said side rails;

said end rails having an end wall portion engages an associated side rail and is connected thereto to resist disengagement of said end rails from said side rails; and a slidable adjusting member slidably engaged with at least one of said end rails adjustably engaging said panel member and position and retain said panel member relative to one of said end rails.

35. The adjustable, fastenerless modular shutter of claim 34, wherein said at least one end rail includes an adjustment support portion that slidably receives said adjusting member for unidirectional movement of said adjusting member toward said panel member.

36. The adjustable, fastenerless modular shutter of claim 35 further including a pair of guide walls extending from said adjustment support portion, said guide walls including engaging members disposed thereon engaging said adjusting member.

37. The adjustable, fastenerless modular shutter of claim 36, wherein said adjusting member includes locking elements thereon that coact with said engaging members securing said adjusting member relative to said end wall portion of said end rail permitting movement of said adjusting member away from said end wall portion and toward said panel member.

38. The adjustable, fastenerless modular shutter of claim 34, wherein said side rails further include a hook portion extending inwardly from said outer wall, and wherein said end rails include a transverse bracing support member engaging with said hook portion.

39. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of end portions disposed along the sides thereof, said end portions being oriented generally parallel to said inner walls of said side rails, each of the end portions engage an associated side rail securing said panel member to each of said side rails;

said end rails having an end wall portion, and including a pair of wing-like portions extending from each side of the end wall, said wing-like portions abut said side rails and terminate at about a juncture with the outer wall of said side rails, each of said wing-like portions includes a first transverse extending bracing support member that engages said side rail, said bracing support member defining an opening therein for receiving a fastener to fasten said shutter to the side of an associated building.

40. The adjustable, fastenerless modular shutter of claim 39 including a second pair of bracing support members extending transverse to each of said wing-like portions, each of said bracing support members engage a respective one of said side rails of differing widths.

41. The adjustable, fastenerless modular shutter of claim 40, wherein each of said wing-like portions includes a base portion and a severable portion and wherein one of said bracing support members is positioned on said severable portion of each wing-like portion.

42. The adjustable, fastenerless modular shutter of claim 39, wherein said side rails further include a hook portion extending inwardly from said outer wall, and wherein at least one of said transverse bracing support members engages with said hook portion.

43. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said outer wall having a hook portion extending inwardly therefrom, said side rails being spaced apart one from the other with said inner walls facing each other and lying in generally parallel planes;

said panel member having a central portion and a pair of end portions disposed along the sides thereof, said end portions being oriented generally parallel to said inner walls of said side rails, each of the end portions engage an associated side rail securing said panel member to each of said side rails;

said end rails having an end wall portion, and including a pair of wing-like portions extending from each side of the end wall, said wing-like portions abut said side rails and terminate at about a juncture with the outer wall of said side rails, each of said wing-like portions include a transverse extending bracing support member that engages said side rails at said hook portion.

44. The adjustable, fastenerless modular shutter of claim 43, wherein each of said wing-like portions further includes a second bracing support member defining an opening therein that receives a fastener to fasten said shutter to the side of an associated building.

45. The adjustable, fastenerless modular shutter of claim 44, wherein each of said wing-like portions includes a base portion and a severable portion and wherein one of said bracing support members is positioned on said severable portion of each wing-like portion.

46. The adjustable, fastenerless modular shutter of claim 45 including a slidable adjusting member that slidably engages at least one of said end rails adjustably engaging said panel member relative to one of said end rails.

47. A fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes; each of the inner walls defining a longitudinal track therein having a plurality of longitudinally spaced apart openings formed therein;

said panel member having a central portion and a pair of runner portions disposed along the sides thereof, said runner portions being oriented generally parallel to said inner walls of said side rails, each of said runner portions engaging an associated side rail to secure said panel member to each of said side rails; and said end rails having a front wall and an end wall portion, said end wall portion being oriented transverse to said front wall and extending rearwardly therefrom and including spaced apart runner portions slidably received in a corresponding track of said side rails, each of said runner portions including a locking portion having at least one projection that engages one of said openings formed in the corresponding track to resist disengagement of said end rails from said side rails.

48. The fastenerless modular shutter as claimed in claim 47, wherein each of said runner portions includes a plurality of spaced apart projections that cooperate with said openings formed in said tracks so that at least one of said projections extend through a corresponding opening.

49. The fastenerless modular shutter as claimed in claim 48, wherein said projections are configured so as to facilitate their movement into and out of said openings as said end rails are inserted into said side rails and to resist their movement out of said openings if forces are applied that tend to separate said end rails from said side rails.

50. The fastenerless modular shutter claimed in claim 48, wherein said openings extend through said inner wall.

51. The fastenerless modular shutter as claimed in claim 47, wherein said projections have engagement portions that are movable between a first position in a plane that extends into said openings and a second position in a plane that extends through said track.

52. The fastenerless modular shutter as claimed in claim 50, wherein said engagement portions flex between their first and second positions, said engagement portions being biased into their first positions.

53. The fastenerless modular shutter claimed in claim 47, wherein said track includes a retaining channel at least a portion of which is offset from a plane of the inner wall, said spaced apart openings extend through a wall defining said retaining channel, said at least one projection of said runner portions having a shape complimentary to the shape of said retaining channel and extending into said retaining channel to engage a corresponding one of said openings.

54. The fastenerless modular shutter claimed in claim 52, wherein said retaining channel and said projection are generally L-shaped in cross-section.

55. The fastenerless modular shutter claimed in claim 53, wherein said locking portion includes a plurality of longitudinally spaced apart projections, each of said projections including a leg portion that is configured so as to facilitate its movement into and out of said openings as said end rails are inserted into said side rails and to resist its movement out of said openings if forces are applied that tend to separate said end rails from said side rails.

56. The fastenerless modular shutter claimed in claim 54, wherein said leg portions have engagement portions associated with the distal ends thereof that are movable between a first position in a plane that extends into said openings and a second position in a plane that extends through said retaining channel.

57. The fastenerless modular shutter claimed in claim 56, wherein said engagement portions flex between their first and second positions, said engagement portion being biased into their first positions.

58. The fastenerless modular shutter claimed in claim 48, wherein said track is defined in part by a hook portion formed at an edge thereof, and said openings extend through said hook portion.

59. The fastenerless modular shutter claimed in claim 58, wherein said hook portion includes an end wall portion and said openings extend through said end wall portion.

60. The fastenerless modular shutter claimed in claim 58, wherein said hook portion includes a side wall portion and said openings extend through said side wall portion.

61. An adjustable, fastenerless modular shutter comprising:

a pair of side rails, a panel member disposed between and secured to said side rails, and end rails secured to said side rails and disposed at either end of said panel member enclosing said panel member;

each of said side rails having a front wall, a generally planar inner wall, and an outer wall, said side rails being spaced apart one from the other with said inner walls facing each other and lying in generally parallel planes;

said panel member having a central portion and a pair of end portions disposed along the sides thereof, said end portions being oriented generally parallel to said inner walls of said side rails, each of the end portions being received in an associated side rail to engage said panel member with each of said side rails;

said end rails having an end wall portion that engages an associated side rail and is connected thereto to resist disengagement of said end rails from said side rails; and an adjusting member selectively engaged with at least one of said end rails to adjustably engage said panel member and position and retain said panel member relative to one of said end rails.

62. The adjustable, fastenerless modular shutter of claim 61, wherein said at least one end rail includes a support portion that receives said adjusting member for selective positioning of said adjusting member with respect to said panel member.

63. The adjustable, fastenerless modular shutter of claim 62, wherein said adjusting member includes a plurality of longitudinally spaced apart grooves that selectively receive a projection associated with said support portion.

64. The adjustable, fastenerless modular shutter of claim 63, wherein said adjusting member is an elongated, generally rectangular block, said block having said grooves on opposite surfaces thereof, and said support portion includes spaced apart facing projections that are selectively received in said grooves.

65. The adjustable, fastenerless modular shutter of claim 61, wherein said adjusting member includes an attachment portion that is attached to said at least one end rail.

66. The adjustable, fastenerless modular shutter of claim 65, wherein said attachment portion is a strap connected to one end to said adjusting member and at its other end to said at least one end rail.

* * * * *